United States Patent [19]

Nagashima et al.

[11] Patent Number: 4,644,841

[45] Date of Patent: Feb. 24, 1987

[54] ELECTRONIC MUSICAL INSTRUMENT

[75] Inventors: Yoichi Nagashima; Eiji Nagashima, both of Shizuoka, Japan

[73] Assignee: Kabushiki Kaisha Kawai Gakki Seisakusho, Japan

[21] Appl. No.: 760,316

[22] Filed: Jul. 29, 1985

[30] Foreign Application Priority Data

Jul. 31, 1984 [JP] Japan ..... 59-162048

[51] Int. Cl.[4] ..... G10H 1/02; G10H 1/057

[52] U.S. Cl. ..... 84/1.1; 84/1.01; 84/1.26

[58] Field of Search ..... 84/1.01, 1.26, 1.1, 84/1.27; 340/365 E, 365 A

[56] References Cited

U.S. PATENT DOCUMENTS 3,882,751 5/1975 Tomisawa ..... 84/1.1

FOREIGN PATENT DOCUMENTS 0029134 2/1982 Japan ..... 340/565 E

*Primary Examiner*—S. J. Witkowski
*Assistant Examiner*—David Warren
*Attorney, Agent, or Firm*—McGlew and Tuttle

[57] ABSTRACT

An electronic musical instrument which has a keyboard and creates a musical tone by striking keys of the keyboard, is provided with an operation control circuit and an adder both for effecting keyboard switch chattering prevent operation processing and touch response select operation processing, a timing control circuit for controlling the switching between the chattering preventing operation and the touch response detecting operation and the scanning of the keyboard switches to detect their status, a musical tone generator for performing a musical tone generating operation asynchronously with the keyboard switch scanning operation, the keyboard switch chattering preventing operation and the touch response detecting operation, and a transfer circuit for transferring touch response information to the musical tone generator. High-speed touch response detecting operation processing and chattering preventing operation processing which are difficult to execute by a CPU are carried out by the operation control circuit and the adder on a time-shared basis, and data is properly transferred to the musical tone generator which performs the musical signal generating operation asynchronously with the abovesaid operations, thereby implementing low cost touch response processing which is free from hardware limitations on the number of tones to be simultaneously produced and the generator assignment system. Furthermore, data for internal processing is set for two words on a time-shared basis, and touch response data which has such a natural temporal variation curve as is obtainable with a time constant circuit system is directly operated by the operation control circuit and the adder is then rendered to one-word external output data of high precision and resolution, thereby effectively reflecting the tough response data in musical parameters of musical tones to be created.

7 Claims, 56 Drawing Figures

ELECTRONIC MUSICAL INSTRUMENT

BACKGROUND OF THE INVENTION

1. Field of the Invention

The present invention relates to an electronic musical instrument which creates a musical sound which has a touch response characteristic corresponding to the key striking force.

2. Description of the Prior Art

In conventional electronic musical instruments such as an electronic organ, a synthesizer and so forth, a variety of touch response systems have been proposed for detecting performance information such as the key striking velocity, pressure and impact force. For example, one of the conventional systems is, for example, to detect, as touch response information, the key striking pressure by means of a piezoelectric element, pressure-sensitive element or like pressure sensor provided for each keyboard. But this system has the defects of substantial variations in the output analog quantities of the individual sensors, difficulties in the detection of pressure and high cost.

As a system for detecting the key striking velocity through utilization of a time constant circuit which is made up of a resistance element and a capacitance element, there has been proposed a system wherein charges stored in the capacitive element are discharged only for a period of time corresponding to the time difference between status changes of two switches which are mounted on a keyboard and temporally actuated, thereby detecting an exponential decrease in the voltage across the capacitance element. But this system encounters difficulties in equally setting individual time constants and calls for a relatively large capacity capacitance element, and hence is not suitable for microfabrication as an LSI or the like.

Another conventional system has been proposed which measures the time interval only between the status changes of the abovesaid two temporally-actuated switches by means of time measuring circuits respectively corresponding to individual keyboards, but this system is very expensive. As a modification of the technique for detecting the depressed key state through use of a microprocessor (hereinafter referred to as a CPU), there has been proposed a system which scans the status changes of the two switches for each key by the CPU to detect the time difference between their status changes by means of software, or by an external hardware arrangement, but this system has the shortcoming that a touch response characteistic of sufficient resolution cannot be obtained owing to a limitation on the processing speed rate of the CPU.

Another conventional system is one that is intended to increase the substantial processing speed of the CPU by assigning time measurement proseccing channels smaller in number than the key boards used at the moment of detection of a change in the switch status, but this system is defective in that the number of tones to be produced simultaneouly and the tone generator assignement method are limited in terms of hardware.

Another conventional system is one that employs a data area corresponding to each keyboard and a counter to be used on a time-shared basis and counts only the time interval occurring between status changes of the abovementioned two temporally actuated switches. With this system, however, since the counter output has no such a natural temporal variation curve as is obtainable with the aforesaid time constant circuit system, it is necessary to use a circuit which performs a data translation and refers to a data translation table.

As regards chattering inherent in keyboard switches, a conventional masking method by a software timer of a CPU scanning circuit which detects only the ON-OFF state of switches cannot be used in terms of processing speed. It is therefore necessary to provide a chattering preventing circuit in a hardware form for each keyboard. A touch response characteristic of satisfactory accuracy cannot be obtained without such chattering preventing means, but the provision of such means will inevitably increase the manufacturing costs.

In general, a touch response detect operation processing block and a digital musical tone generation processing block perform optimum actions at entirely different timing. In this case, it is possible to employ a handshaking system or buffer memory for transferring touch response information, but much time is consumed for the transfer process of each touch response information. This problem can be solved by simultaneous actuation of the both blocks, but since the amount of data to be processed varies with the state of performance, either one of the blocks is always placed in the wait state, so the efficiency of processing is low.

In a touch response operation processing system it has been proposed to efficiently carry out a touch response operation in units of eight or 16 bits for one word in view of limitations on the number of bits of a RAM or CPU. With one word-eight bits, however, a touch response characteristic of sufficiently high accuracy cannot be obtained. With one word-16 bits, the accuracy of the touch response characteristic is high but the manufacturing costs increases very much.

SUMMARY OF THE INVENTION

It is therefore an object of the present invention to provide an electronic musical instrument which is free from the abovementioned defects of the prior art and rich in musicality.

Briefly stated, the electronic musical instrument of the present invention is provided with a common operation control circuit and an adder which perform operation processing for preventing chattering of keyboard switches and operation processing for detecting touch response, a timing control circuit for controlling the switching of the chattering preventing operation and the touch response detecting action and the scanning of the keyboard switches for detecting their status, a musical tone generator for generating musical tones asynchronously with the switch scanning action, the switch chattering preventing action and the touch response detecting action, and a transfer circuit for transferring touch response information to the musical tone generator. The high-speed touch response detecting operation process and chattering preventing operation processing that are difficult to perform with a CPU are carried out by the operation control circuit and the adder on a time-shared basis, and appropriate data is transferred to the musical tone generator which performs the musical tone generating operation asynchronously with the abovesaid actions and in the optimum state, thereby implementing a low-cost touch response process with no restrictions imposed on the number of tones to be simultaneously produced and the tone generator assignment system are not restricted in terms of hardware. Furthermore, internal processing data is set for two words on the time-shared basis, and touch response data which has such a natural temporal variation curve as is obtainable with the time constant circuit system is directly operated by the operation control circuit and the adder and is then rendered to one-word external output data of high accuracy and resolution, thereby effectively reflecting the touch response data in musical paramenters of musical tones to be created.

Other object, features and advantages of the present invention will become more fully apparent from the following detailed description taken in conjunction with the accompanying drawings.

DESCRIPTION OF THE PREFERRED EMBODIMENTS

Figure 1:
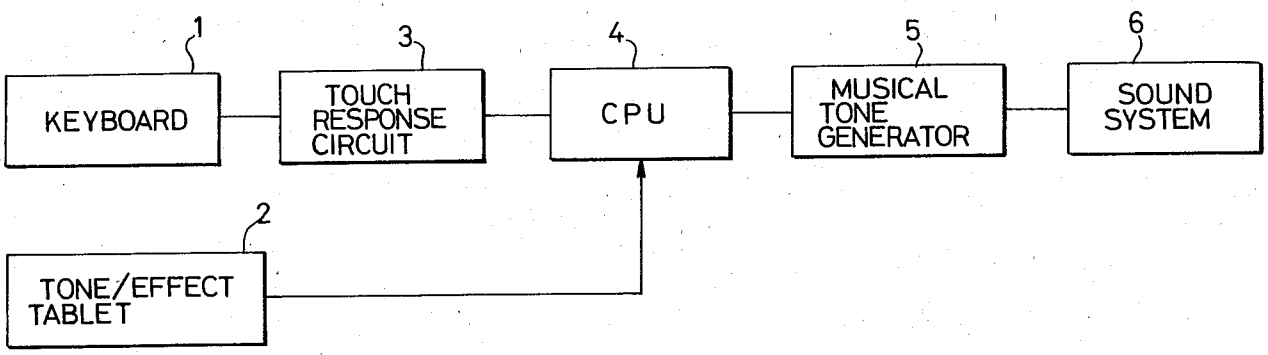
Fig. 1 is a conceptual block diagram explanatory of the constitution of the electronic musical instrument of the present invention.

FIG. 1 is a conceptual block diagram explanatory of the constitution of the electronic musical instrument of the present invention. In FIG. 1, reference numeral 3 indicates a touch response circuit which forms the principal part of the present invention, and 4 a CPU for controlling the entire arrangement of the musical instrument of the present invention.

The touch response circuit 3 detects musical performance data on a keyboard 1 and performs required chattering preventing operation processing and touch response data detecting operation and then transfers the resulting data to the CPU 4, along with ON-OFF information of the keyboard 1. Based on information from a tone/effect tablet 2 and the touch response circuit 3, the CPU 4 performs processing for generator assignment, tone setting, touch response parameter setting and so forth. A musical tone generator 5 generates a musical signal which has a touch response characteristic corresponding to various data provided from the CPU 4. The musical signal from the musical tone generator 5 is applied to a sound system 6 including an effect circuit, an amplifier and a speaker, wherein it is converted to an acoustic signal for tone production.

Figure 2:
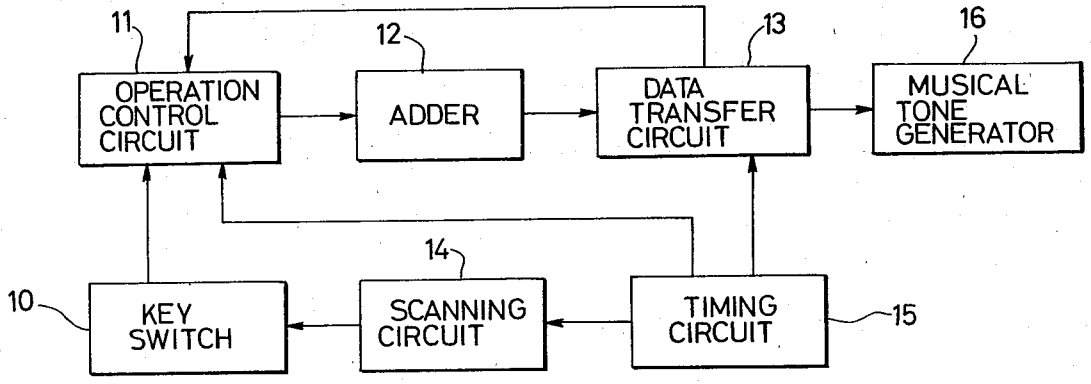
FIG. 2 is a block diagram for explaining chattering preventing operation processing and touch response detect operation processing blocks according to the present invention.

FIG. 2 is a block diagram for explaining a chattering prevent operation processing block and a touch response data detecting operation block which are implemented by the keyboard 1, the touch response circuit 3, the CPU 4 and circuits associated therewith in FIG. 1. In FIG. 2, reference numeral 10 indicates key switches provided on the keyboard 1, 11 an operation control circuit which performs a chattering preventing operation processing or touch response data detection on the time-shared basis, 12 an adder, 13 a data transfer circuit, 14 a scanning circuit for scanning the key switches 10 for detecting their status change, 15 a timing circuit for changing over the phases of a chattering preventing action and a touch response detecting action and for generating a keyboard switch scanning signal, and 16 a musical tone generator including the CPU 4, the musical tone generator 5 and circuits associated therewith.

When the timing circuit 15 provides the keyboard switch scanning signal to the scanning circuit 14, the key switches 10 are scanned and their play or performance information is applied to the operation control circuit 11. The operation control circuit 11 responds to a phase signal from the timing circuit 15 to effect the chattering prevent operation processing or touch response data detecting action on the time-shared basis and, in each phase, performs such bit operations as a bit shift, a bit invert, a logical operation, setting and resetting, thereafter providing the resulting data to the adder 12. The data transfer circuit 13 subjects the output data of the adder 12 to a bit shift or like operation, as required, and supplies the output data to the operation control circuit 11. Further, the transfer circuit 13 responds to a phase signal from the timing circuit 15 to temporarily store the data and to transfer it to the musical tone generator 16.

Figure 3:
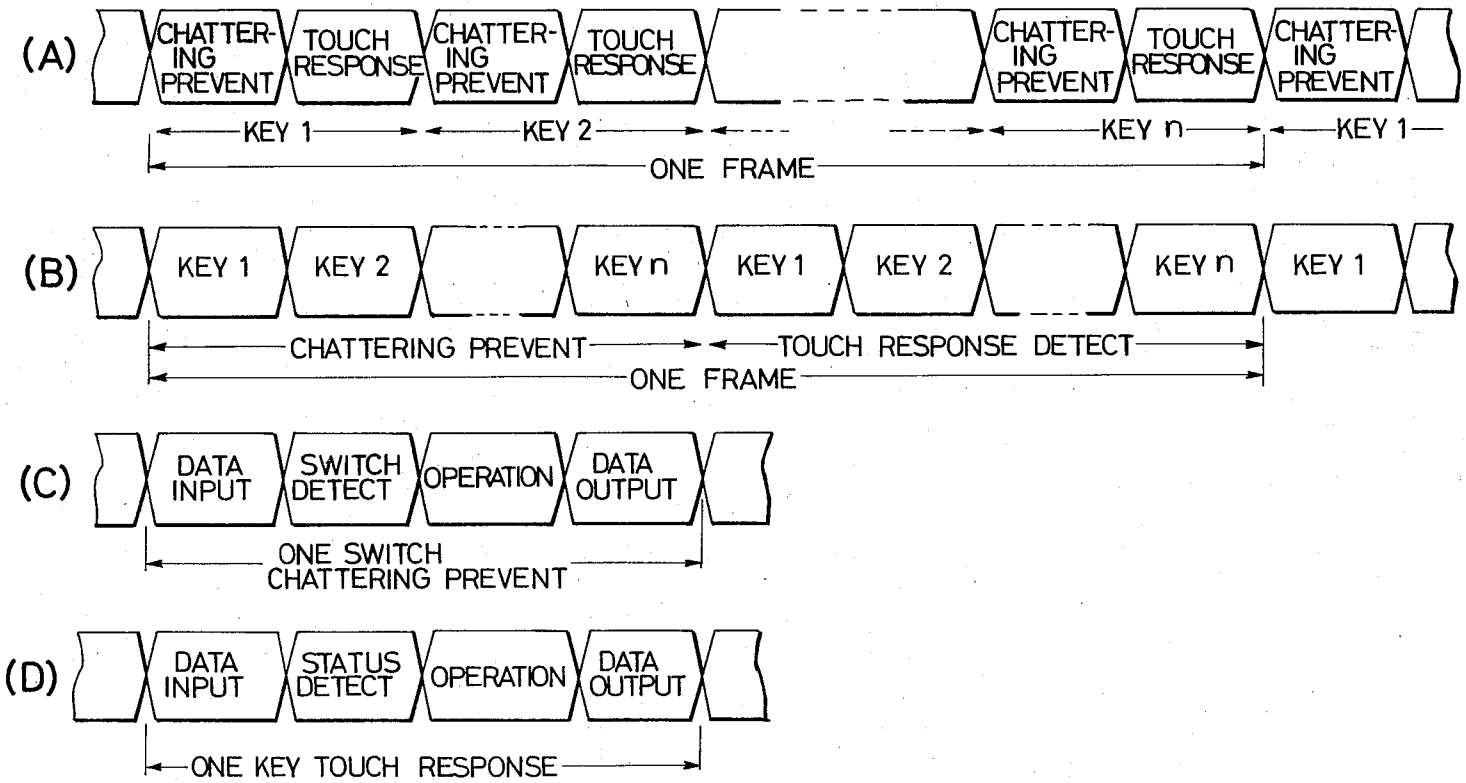
FIGS. 3A to 3D are diagrams for explaining the operation of the arrangement shown in FIG. 2.

A description will be given, with reference to FIG. 3, of the abovesaid operation, of the circuit arrangement shown in FIG. 2. In the case of processing a plurality of keyboard switches KEY1, KEY2, . . . and KEYn, it is possible to employ such a method as shown in FIG. 3A in which the chattering prevent operation processing is performed for a certain one of the key switches and then the touch response data detect operation processing is conducted for the same switch, followed by the processing of the next switch. In this case, assuming, for example, that 61 keys are processed using 1 μsec for each of the chattering prevention and the touch response detection, one frame period for scanning a certain keyboard will be 122 μsec and resolution for the touch response detection wil1 be increased several to 10 times higher than in the case of effecting the same process by a CPU. It is also possible to adopt such a method as shown in FIG. 3B in which the chattering prevent operation processing is conducted first for all the keys and then the touch response detection operation processing is effected for all the keys. With this method, the touch response detecting resolution is substantially equal to that in the case of FIG. 3A, but since the delay which results from the switching of the operation control circuit 11 between the chattering prevent operation processing and touch response data detect operation processing is reduced, this method is of particular utility when employed in the case of speeding up the processing for higher resolution. FIG. 3C illustrates an example of the chattering prevent operation processing of the specific operative arangement shown in FIG. 2. In this case, the phase of operation is subdivided by the timing circuit 15, and according to the arrangement of the operation control circuit, two or more of such operations can be processed in parallel. In a first phase the previous chattering preventing operation parameter is transferred from the data transfer circuit 13 to the operation control circuit 11, and in the next phase information on the key switches 10, including chattering, is supplied. In the next phase the chattering prevent operation takes place based on the abovesaid two kinds of input information, and in the next phase chattering-removed switch information and a new chattering prevent operation parameter are transferred to the transfer circuit 13. FIG. 3D shows an example of the touch response detection processing operation by the arrangement shown in FIG. 2. The phase of operation is subdivided by the timing circuit 15, and according to the arrangement of the operation control circuit 11, some of such operations can be processed in parallel. In a first phase the previous touch response detect operation parameter is transferred from the transfer circuit 13, and in the next phase an event state of the keyboard is detected from the status of first and second key switches. Based on the two input information, a touch response value detect operation takes place in the next phase, and in the following phase the keyboard event state information and a new touch response detect operation parameter are transferred to the transfer circuit 13. What is important in this case is the function of the operation control circuit 11 for performing the chattering prevent operation processing and the touch response data detect operation processing by the same adder 12. This permits simplification of a conventional enormous circuit structure and implements a touch response system which is suitable for fabrication as an LSI.

Figure 4:
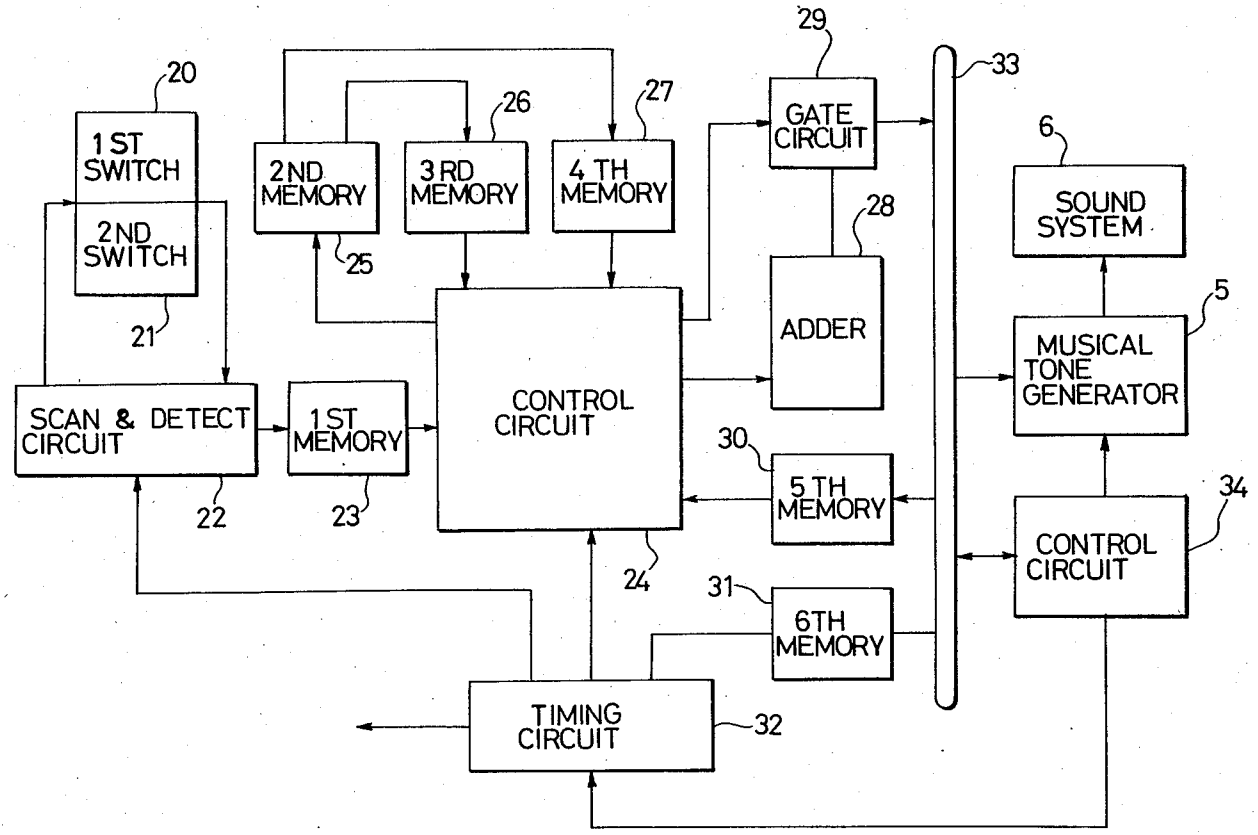
FIG. 4 is a block diagram illustrating an embodiment of a specific circuit arangement including the chattering prevent operation processing and the touch response detecting operation processing block shown in FIG. 2.

FIG. 4 illustrates in block form an embodiment of the circuit arrangement which includes the chattering prevent operation processing block and the touch response detecting block depicted in FIG. 2. Reference numeral 20 indicates a first switch which is provided for each key, 21 a second switch which is provided for each key and changes its state after the first switch 20, 32 a timing circuit which generates phase signals for triggering the chattering eliminating operation and the touch response detecting operation, a scanning signal, an address signal and a control signal, 22 a scan and detect circuit which detects the status of either the first or second switches 20 or 21 specified by the scanning signal from the timing circuit 32, 23 a first memory which responds to the control signal from the timing circuit 32 to temporarily store / the switch detection signal from the scan and detect circuit 22, 24 a control circuit which performs predetermined control operations in response to the phase signal and the control signal from the timing circuit 32, 25 a second memory which responds to the control signal from the timing circuit 32 to temporarily store the output signal of the first memory 23 and a chattering eliminated switch status signal from the control circuit 24, 26 a third memory which responds to the control signal from the timing circuit 32 to temporarily store the output signal of the second memory 25 and to supply it as first switch information to the control circuit 24, 27 a fourth memory which responds to the control signal from the timing circuit 32 to temporarily store the output signal of the second memory 25 and to supply it as second switch information to the control circuit 24, 33 a data bus which shares various data signals and various control signals of the entire system on the time-shared basis, 30 a fifth memory which responds to the control signal from the timimg circuit 32 to temporarily store a signal on the data bus 33 and to supply it to the control circuit 24, 31 a sixth memory which responds to the control signal and the address signal from the timing circuit 32 to temporarily store the signal on the data bus 33, 28 an adder which performs and add operation of the output signal from the control circuit 24 to obtain touch response information or chattering prevent information, 29 a gate circuit which responds to the control signal from the timing circuit 32 to effect predetermined bit operations for the output signal of the adder 28 and the output signal of the control circuit 24 and to provide them on the data bus 33, 5 a musical tone generator which are supplied with a musical parameter by the signal on the data bus 33 to generate a musical tone, and 34 a control circuit which controls the musical tone generator 5 and the timing circuit 32 so that the touch response characteristic is reflected in the musical signal to be created by the musical tone generator 5.

Figure 5:
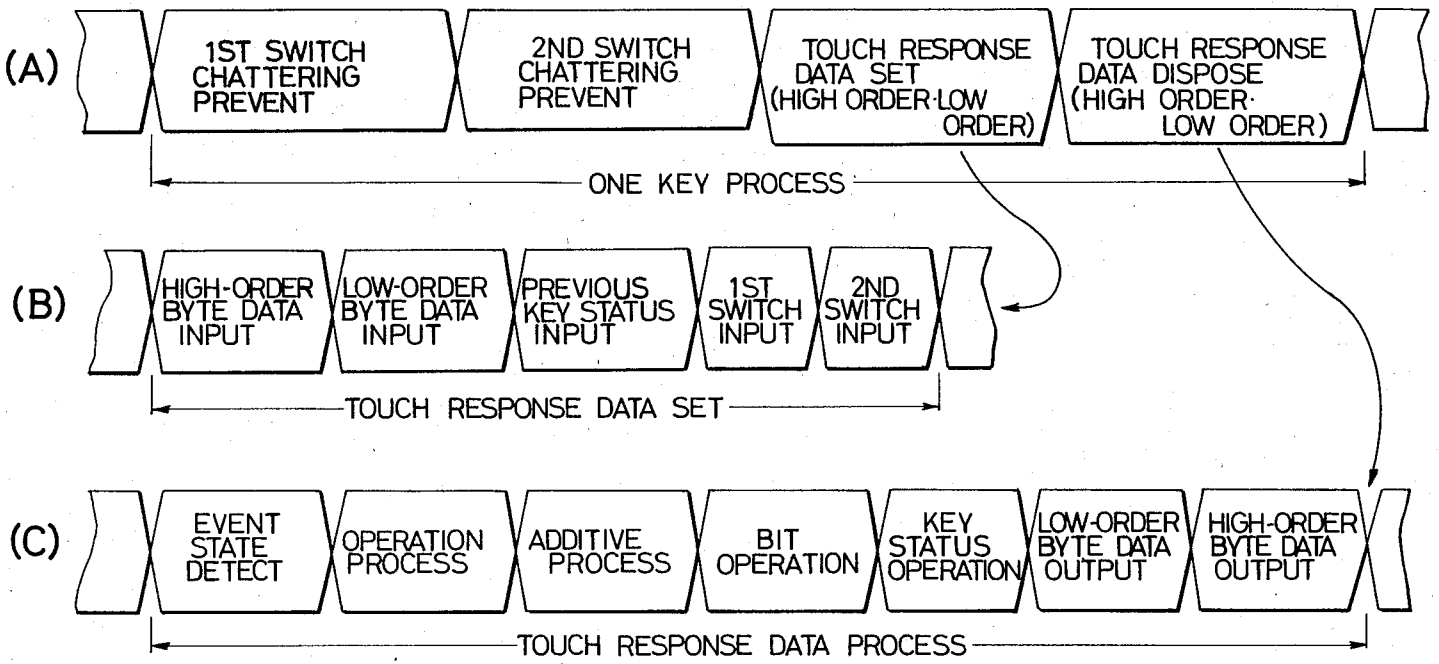
FIGS. 5A to 5C are diagrams for explaining the operation of the specific circuit arrangement depicted in FIG. 4.

Referring now to FIG. 5, the operation of the circuit arrangement depicted in FIG. 4 will be described. For processing one key of a certain keyboard, it is possible to employ such a flow of processing as shown in FIG. 5A. In the first phase the scan and detect circuit 22 responds to the scanning signal from the timing circuit 32 to detect the status of the first switch 20 and supplies the detected information via the first memory 23 to the control circuit 24. On the other hand, a chattering prevent operation parameter is provided from the fifth memory 30 to the control circuit 24, and data resulting from the chattering prevent operation by the adder 28 is provided via the third memory 26 and the gate circuit 29 on the data bus 33. In the next phase the scan and detect circuit 22 responds to the scanning signal from the timing circuit 32 to detect the status of the second switch 21 and applies the detected information via the first memory 23 to the control circuit 24. At the same time, the chattering prevent operation parameter is supplied from the fifth memory 30 to the control circuit 24 and data obtained by the chattering prevent operation by the adder 28 is provided via the second memory 25 to the fourth memory 27 and via the gate circuit 29 on the data bus 33. The data on the data bus 33 is temporarily stored in the sixth memory 31 appropriately and, as required, is transferred to the musical tone generator 5 and the control circuit 34 on a real-time basis. The next phase is a phase in which to set data necessary for the touch response detect operation processing. FIG. 5B shows an example in which the touch respose detection is conducted over a two-byte period with high accuracy. In FIG. 5B, the high-order byte of the touch response detect operation parameter on the data bus 33 is supplied via the fifth memory 30 to the control circuit 24, after which the low-order byte of the touch response detect operation parameter on the data bus 33 is provided via the fifth memory 30 to the control circuit 24. Then previous keyboard actuation infomation on the data bus 33 is provided via the fifth memory 30 to the control circuit 24, and actuation information of the first switch 20 having its chattering eliminated is supplied via the third memory 26 to the control circuit 24. Further, actuation information of the second switch 21 having its chattering eliminated is provided via the fourth memory 27 to the control circuit 24. The following phase is a phase in which to execute the touch response detect operation processing. FIG. 5C shows an example in which the touch response detection is carried out for a two-byte period with high accuracy. In FIG. 5C, the operation mode of the touch response detect operation processing is determined by the control circuit 24 based on the actuation information of the first and second switches 20 and the 21 and the previous keyboard actuation information, and if necessary, new keyboard actuation information is created. For convenience of description, let it be assumed that the first and second switches 20 and 21 are both active-high, that is, OFF when released and ON when depressed. This can easily be achieved by providing an inverter circuit between the scan and detect circuit 22 and the first memory 23, as required. Now consider combinations of the actuation information of the first switch 20 and the actuation information of the second switch 21.

| | | |
|---|---|---|
| (a) | First switch: OFF<br>Second switch: OFF | |
| | | Released state |
| (b) | <First switch: ON> | |
| | | Event occurs |
| (c) | First switch: ON<br>Second switch: OFF | |
| | | Transition stage |
| (d) | <Second switch: OFF> | |
| | | Event occurs |
| (e) | First switch: ON<br>Second switch: ON | |
| | | Depressed state |
| (f) | <Second switch: OFF> | |
| | | Event occurs |
| (g) | First switch: ON<br>Second switch: OFF | |
| | | Return stage |
| (h) | <First switch: OFF> | |
| | | Event occurs |
| (i) | First switch: OFF<br>Second switch: OFF | |
| | | Released state |

Figure 6:
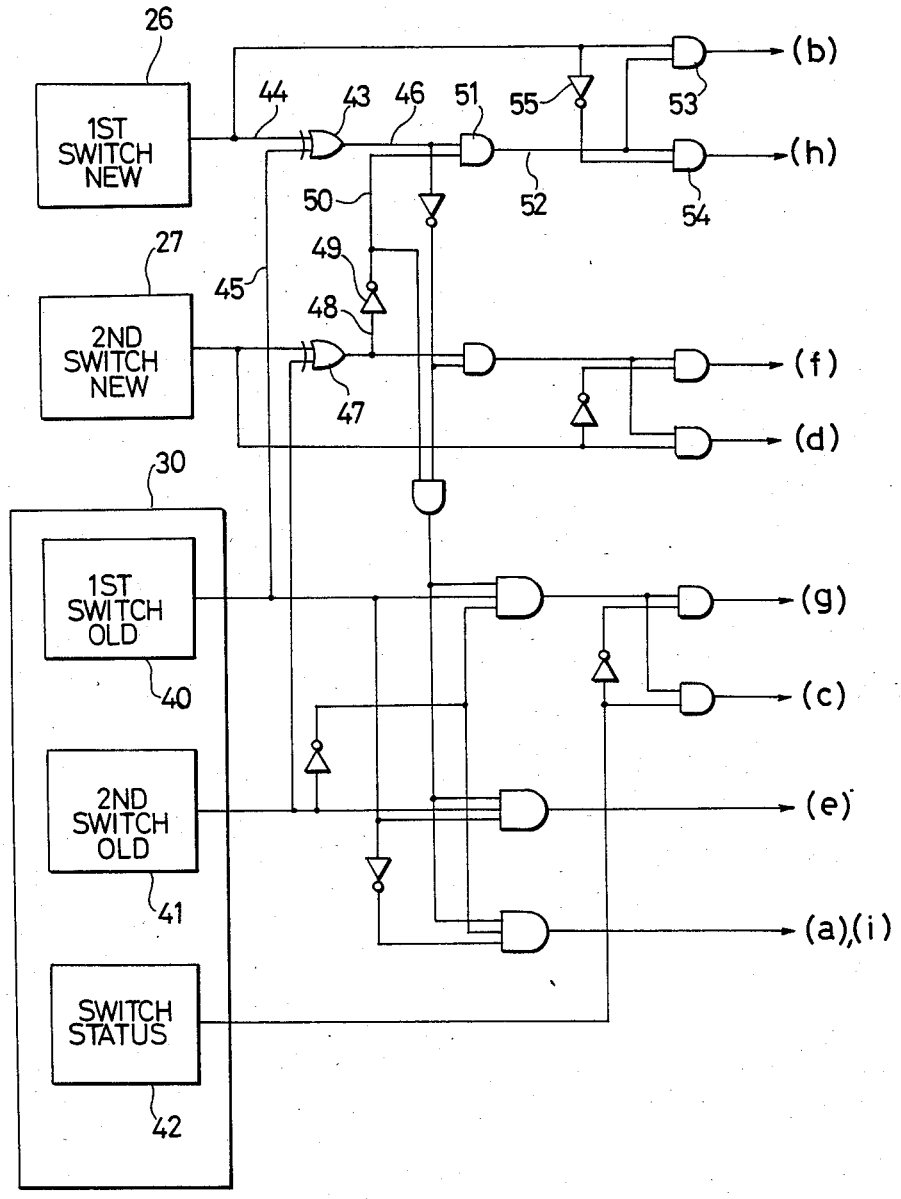
FIG. 6 is a diagram showing an example of a logic circuit explanatory of the operation of the arrangement shown in FIG. 4.

Thus the above nine kinds of states occur with the lapse of time. These states occur with the lapse of time because the actuation information of the first switch 20 which is provided via the third memory 26 to the control circuit 24 and the actuation information of the second switch 21 which is provided via the fourth memory 27 to the control circuit 24 have been subjected to the chattering prevent processing. It is needless to say that if the switch output signals are directly input, then meaningless state chages will be caused by chattering. In order to detect the above nine kind of states to determine the operation mode for the touch response detect operation processing, the control circuit 24 needs to include, for example, such a circuit arrangement as shown in FIG. 6. In FIG. 6, reference numeral 26 indicates a third memory for temporarily storing the first switch information, 27 a fourth memory for temporarily storing the second switch information and 30 a fifth memory for temporarily storing the data on the data bus. The fifth memory 30 is shown to include seventh, eighth and ninth memories 40, 41 and 42. In FIG. 6, the third memory 26 provides new chattering-removed first switch information, and the fourth memory 27 provides new chattering-removed second switch information. On the other hand, the seventh memory 40 provides first switch information obtained by the previous processing, the eighth memory 41 provides second switch information obtained by the previous processing and the ninth memory 42 provides keyboard state information obtained by the previous processing. Supplied with the above input information, such a logic circuit as shown in FIG. 6 decides and operates the aforesaid states (a) to (i). For example, an exclusive-OR gate 43 is supplied with a new first switch signal 44 from the third memory 26 and a previous first switch signal 45 from the seventh memory 40, providing an output signal 46 which goes high only when a status change of the first switch occurs. Similarly, an exclusive-OR gate 47 produces an output signal 48 which goes high only when a status change of the second switch occurs, so an output signal 50 of an inverter 49 goes high only when the status of the second switch remains unchanged. Supplied with the two input signals 46 and 50, an AND gate 51 creates an output signal 52 which serves as an event occurrence signal of the first switch, and this signal is applied to AND gates 53 and 54. The AND gate 53 is also supplied with the new first switch signal 44 from the third memory 26, providing an output signal which is an ON-event status change signal of the first switch corresponding to the aforementioned state (b). On the other hand, the AND gate 54 is supplied with the new first switch signal 44 from the third memory 26 via an inverter 55, providing an output signal which is an OFF-event status change signal of the first switch corresponding to the aforesaid state (h).

Figure 7:
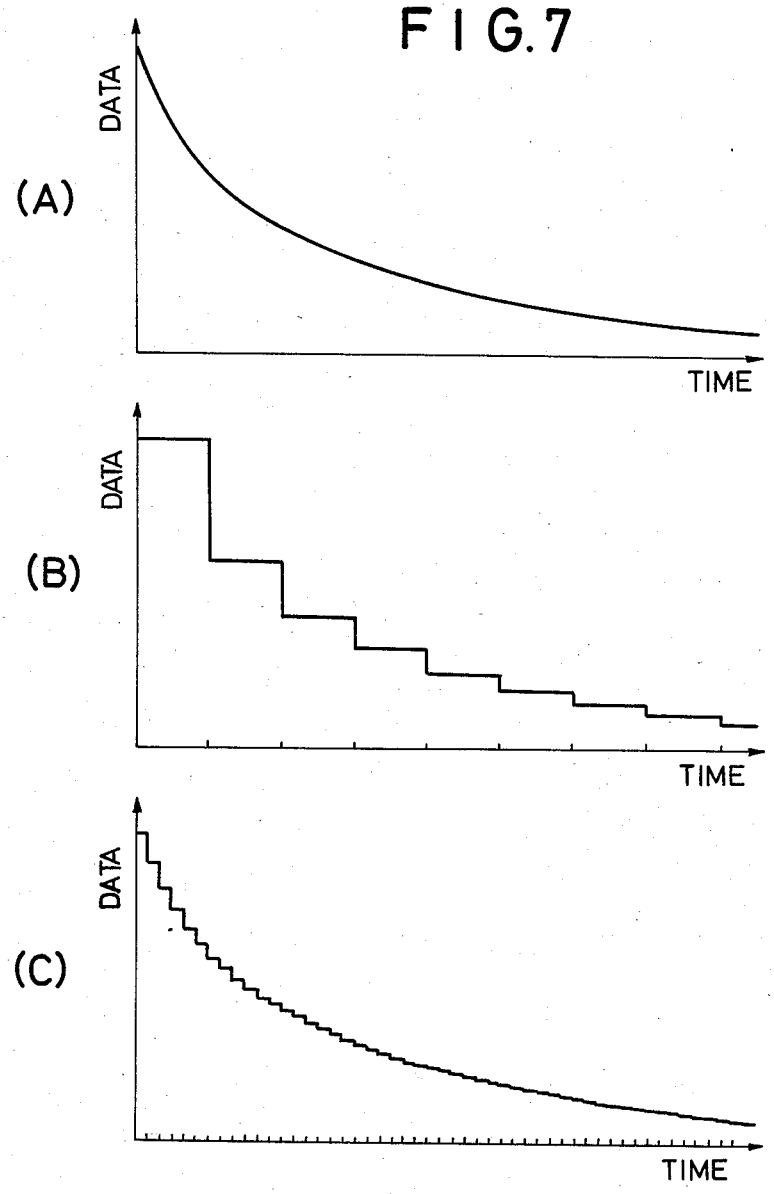
FIGS. 7A to 7C are graphs explanatory of the operation of the specific arrangement depicted in FIG. 4.
Figure 8:
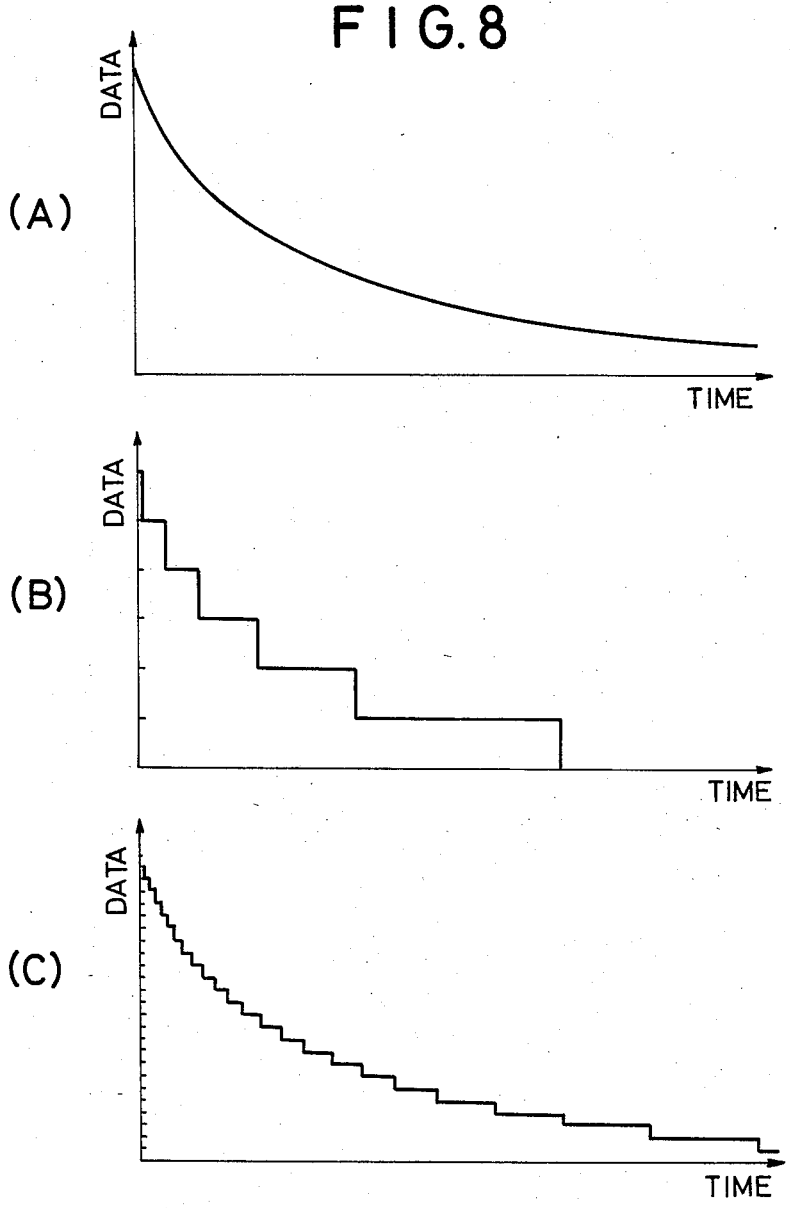
FIGS. 8A to 8C are graphs explanatory of the operation of the specific arrangement depicted in FIG. 4.

In FIG. 5C, when the operation mode of the touch response detect operation processing is determined on the basis of the actuation information of the first and second switches and the previous keyboard actuation information, as described above, the control circuit 24 performs predetermined data processing such as a logical operation, a bit shift and so forth in accordance with the operation mode so as to effect required touch response detect operation processing or chattering prevent operation processing by the adder 28 in the next phase. Incidentally, the touch response detect operation or chattering prevent operation is not limited specifically to an add operation, but in some cases the data is translated to the form suitable for an operation such as a subtracion or multiplication and the data is supplied to a common adder on a time-shared basis, as described later. This offers an operation processing block which is simple in circuit construction and efficient in operation. In the succeeding phase the input data from the control circuit 24 is added by the adder 28, providing an operation output signal. In the next four phases the output signals of the adder 28 and the control circuit 24 are subjected to predetermined bit operations by the gate circuit 29, the output of which is provided on the data bus 33. FIG. 7 shows signal diagrams for explaining this operation, FIG. 7A showing an exponential characteristic curve by a time constant circuit as an example of a kind of ideal touch response detect characteristic. In FIG. 7A the abscissa represents input information provided as the time difference between the event information of the first switch and the event information of the second switch, and the ordinate the output information value of the touch response detect operation. It is seen from FIG. 7A that where the key striking speed is high, that is, where the time difference is small, resolution is high, whereas when the key striking speed is low, that is, when the time difference is large, resolution gradually varies. FIG. 7B shows an example of the output characteristic when the above touch response detect characteristic curve was sampled. Apparently the illustrated output characteristic is not suitable as the touch response characteristic of an electronic musical instrument; in particular, this characteristic is defective in the response in the case where the key striking speed is high, that is, when the time difference is small. FIG. 7C shows an example of the output characteristic obtained by sampling the output characteristic of FIG. 7A at shorter but equal time intervals. Considering that the ratio of sampling between FIGS. 7B and 7C is about four times, it will be understood that the touch response detecting system of the present invention easily achieves sampling with resolution several to 10 times higher than is obtainable with the CPU scanning system. FIG. 8 is a series of graphs showing quantization which is a digital processing parameter which is a data value itself, relative to sampling which is a digital processing parameter on the time axis. FIG. 8A shows, similar to FIG. 7A, as an example of a kind of ideal touch response detect characteristic, on exponential characteristic curve obtained with a time constant circuit. FIG. 8B shows an example of the output characteristic obtained by sampling the characteristic curve of FIG. 8A at sufficiently short time intervals and expressed with fixed steps of certain quantization levels. It is apparent that the output characteristic is inappropriate as the touch response characteristic of an electronic musical instrument and is defective in the response in the case where the key striking speed is low, that is, where the level difference is small. FIG. 8C shows an example of the output characteristic expressed with shorter but fixed steps of quantization levels. Taking into account that the ratio of the accuracy of the quantization level between FIGS. 8B and 8C is about four times, a difference of several bits in the touch response operation will provide an appreciable difference in performance. Incidentally, many electronic musical instruments generally employ systems using general purpose CPUs, RAMs and so forth, and standard data processing is carried out in units of eight bits. In some cases, however, the quantity of eight bits, i.e. 256 steps, is not satisfactory accuracy of processing, and at times players excessively feel uneasy about, for example, variations, errors of the touch response and its quantizing noise for which they have a keen psycological sense. In view of this, in the phase in which the output signals of the adder 28 and the control circuit 24 are subjected by the gatecircuit 29 to predetermined bit operations after the phase in which the operation output signal is obtained by the adder 28, bit operations are performed for internally effecting high accuracy processing up to 2 words-16 bits while externally effecting data processing in one word-eight bit units.

Figure 9:
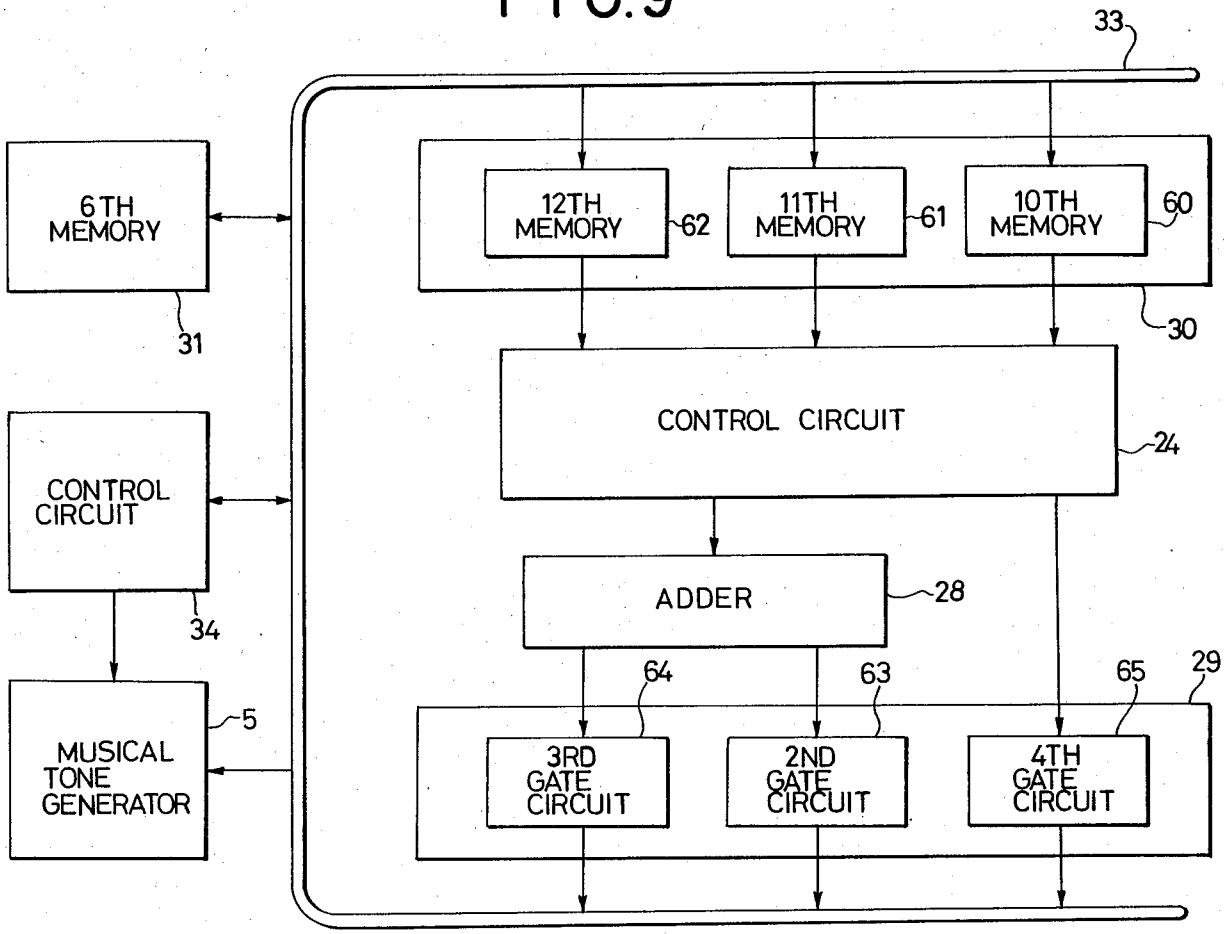
FIG. 9 is a block diagram illustrating a specific arrangement of a bit operation block including a gate circuit 29 in FIG. 4.

FIG. 9 illustrates a specific operative example of the circuit arrangement of a block including the gate circuit 29 for performing the abovementioned bit operations. Reference numeral 24 indicates a control circuit which performs predetermined control operations, 33 a data bus which shares various signals of the entire system on the time-shared basis, 30 a fifth memory which temporarily stores a signal on the data bus 33 and then supplies it to the control circuit 24, 31 a sixth memory which temporarily stores a signal on the data bus 33, 28 an adder which adds the output signal of the control circuit 24, 29 a gate circuit which performs predetermined bit operations for the output signals of the adder 28 and the control circuit 24 and provides the output on the data bus 33, 5 a musical tone generator which is supplied with a musical parameter by the signal on the data bus to create a musical tone and 34 a control circuit which controls the musical tone generator 5 and other circuits to reflect the touch response characteristic in the musical signal to be produced. In this example, the fifth memory 30 includes a tenth memory 60, an eleventh memory 61 and a twelfth memory 62 for temporarily storing the aforesaid switch status information, operation mode information, etc. The gate circuit 29 includes a second gate circuit 63, a third gate circuit 64 and a fourth gate circuit 65 for supplying the aforementioned switch status information, operation mode information, etc. In FIG. 9, various signals on the data bus 33 are properly applied to required parts in the fifth memory 30 on the time-shared basis and are temporarily stored therein. In the twelfth memory 62 are set the switch status information, operation mode information and so forth, in the tenth memory 60 the high-order byte of the touch response detect operation parameter and in the eleventh memory 61 the low-order byte of the touch response detect operation parameter. With such a circuit arrangement, the control circuit 24 and the adder 28 conduct high accuracy touch response detect operation processing in units of two bytes. Assuming, for instance, that the tenth memory 60 sets four bits as the high-order byte of the touch response detect operation parameter and the eleventh memory 61 eight bits as the low-order byte of the touch response detect operation parameter, operation processing of a 12-bit precision is performed in the touch response detect operation circuit, and four and eight bits are respectively provided, as the high-order and the low-order byte of the output signal of the adder 28, on the data bus 33 from the second and third gate circuits 63 and 64 on the time-shared basis. Furthermore, in the case where eight and four bits are respectively set, as the high-order and low-order bytes of the touch response detect operation parameter, in the control circuit 24 from the tenth and eleventh memories 60 and 61 and the adder 28 is set so that a carry output signal is switched to be correctly looped to the least signigicant bit, operation processing of the exactly the same 12-bit precision as in the above is conducted in the touch response detect operation circuit. In this case, by providing eight and four bits as the high-order and low-order bytes of the output signal of the adder 28 on the data bus 33 from the second and third gate circuits 63 and 64, respectively, on the time-shared basis, it is possible to effectively improve the transfer of the output touch response detect operation parameter while retaining exactly the same bit precision in the touch response detect operation processing as in the above. That is, in FIG. 9, the touch response detect operation parameter signal on the data bus 33 is transferred in two direction relative to the sixth memory 31, as required, and is transferred in one direction relative to the tone generator 5, as required. Similarly, the touch response detect operation parameter signal is transferred in two directions as well to the control circuit 34, as required. In this case, if the pattern of the output signal from the adder 28 is modified so that eight and four bits are respectively provided, as the high-order and low-order bytes, on the data bus 33 from the second and third gate circuits 63 and 64 on the time-shared basis, as mentioned above, only the eight bits of the high-order byte are transferred, for example, to the tone generator 5, wherein a touch response is effected based on the 8-bit data so that the musical parameter is reflected in the musical tone to be generated. This means that operation processing of 12-bit precision is carried out in the touch response detect operation circuit and, at the stage of utilizing the data as the touch response information, the data rounded to eight bits is used. Thus the detection precision is appreciably improved though using the same 8-bit information. Furthermore, this reduces the time for data transfer in a system employing an 8-bit data bus, and hence is very advantageous in terms of circuit operation.

In the phase succeeding to the bit operation phase which is executed by the abovesaid operations, the output data such as the first and second switch actuation information and the keyboard actuation information obtained with the control circuit 24 is provided on the data bus 33. The first and second switch actuation information and the keyboard actuation information are supplied to the tone generator 5 and the control circuit 34 on the real-time basis or different timing, wherein they are used as sound information, generator assignment information and released key information. In the following two phases, the high-order and low-order bytes of the output signal of the adder 28 are provided on the data bus 33 from the second and third gate circuits 63 and 64 on the time-shared basis, completing the touch response detect operation for one key. It must be noted here that in the above the touch response detect operation is divided into a plurality of phases for the sake of brevity, and many of the above-described actions can be processed in parallel in the same phase, so the overall processing can be speeded up by parallel processing.

Figure 10:
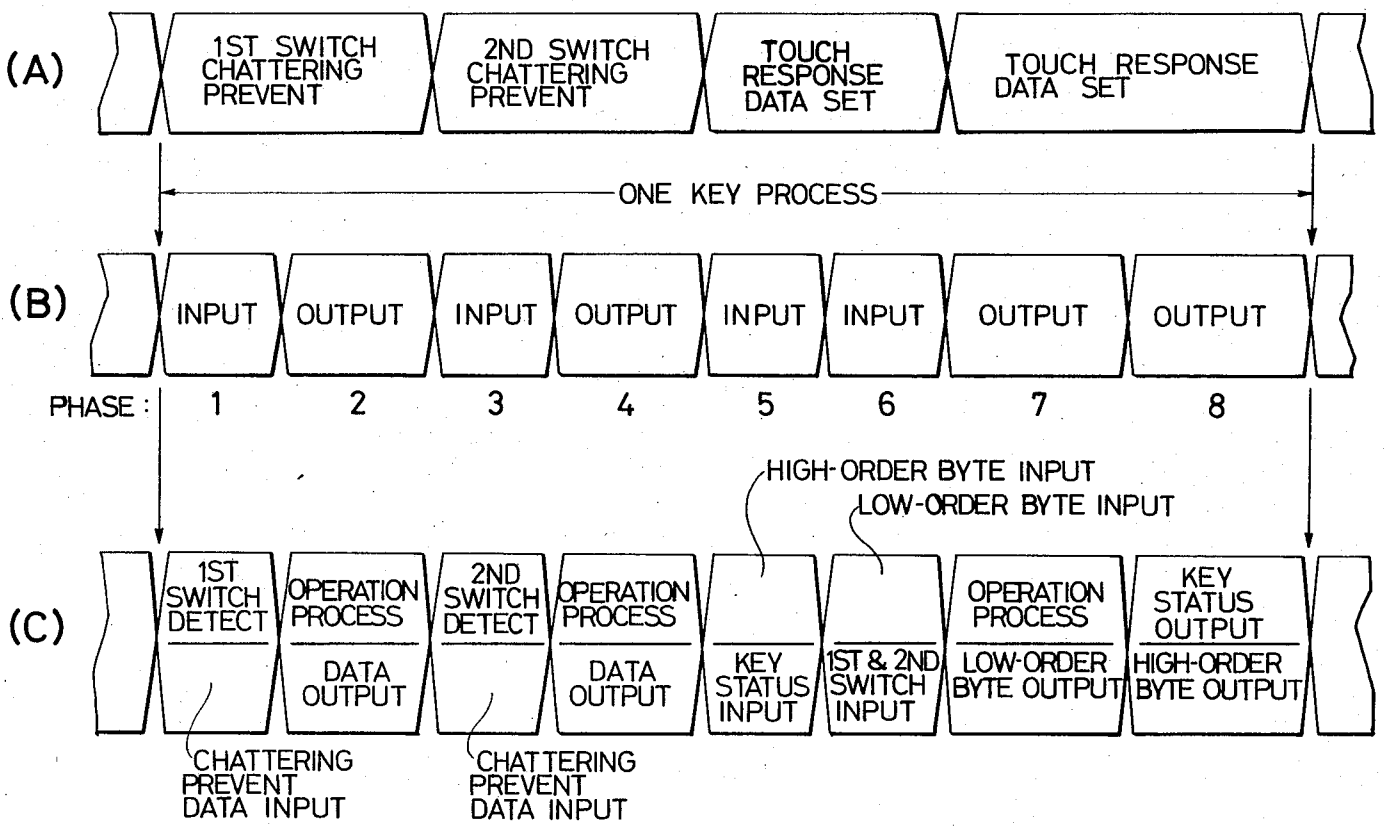
FIGS. 10A to 10C are diagrams for explaining the setting of phase for a parallel processing phase setting operation which is another operation of the circuit arrangement depicted in FIG. 4.

FIG. 10 is inteded for explaining an example of the setting of phases for such parallel processing in the case of the circuit arrangement shown in FIG. 4. The processing is roughly divided into four phases, as shown in FIG. 10A. In the first phase the scan and detect circuit 22 detects the status of the first switch 20 and provided the detected information via the first memory 23 to the control circuit 24. At the same time, the fifth memory 30 supplies the chattering prevent operation parameter to the control circuit 24 and data obtained by the chattering prevent operation by the adder 28 is applied via the second memory 25 to the third memory 26 and via the gate circuit 29 to the data bus 33. In the next phase the scan and detect circuit 22 detect the status of the second switch 21 and provides the detected information via the first memory 23 to the control circuit 24. At the same time, the chattering prevent operation parameter is applied from the fifth memory 30 to the control circuit 24 and the data obtained by the chattering prevent operation by the adder 28 is provided via the second memory 25 to the fourth memory 27 and via the gate circuit 29 on the data bus 33. The third phase is for setting data necessary for the touch response detect operation processing. Also in this case, the touch response detection is carried out using two bytes for high precision. In the fourth phase the touch response detect processing is executed and its results are provided on the data bus 33. Noting the flow of signals, the overall operation is roughly divided, as shown in FIG. 10B, in which the four phases are each subdivided into two, providing a total of eight phases, i.e. a first phase for setting data necessary for the chattering prevent operation of the first switch, a second phase for performing the chattering prevent operation of the first switch to output data, a third phase for setting data necessary for the chattering prevent operation of the second switch, a fourth phase for executing the chattering prevent operation of the second switch to provide data, a fifth phase for setting the high-order byte of data necessary for the touch response detect operation, a sixth phase for setting the low-order byte of the data necessary for the touch response detect operation, a seventh phase for executing the touch response detect operation to output the low-order byte of data, and an eighth phase for performing the touch response detect operation to output the high-order byte of data. FIG. 10C shows the operations which are processed in parallel in each of the eight phases, and the time slots need not always be equal but may be set with the optimum margin in accordance with the quantity of data handled, the transfer rate and so forth. For the most efficient chattering prevent operation and touch response detect operation with such a phase arrangement, it is necessary only to set the chattering prevent operation parameter as eight bits at a time and the touch response detect operation parameter in the form of two bytes-16 bits in two stages. By this, it is possible to easily implement the chattering prevent and touch response detect operation processing with higher precision and at a speed higher about 10 times higher than in the case of the software processing by a CPU.

Figure 11:
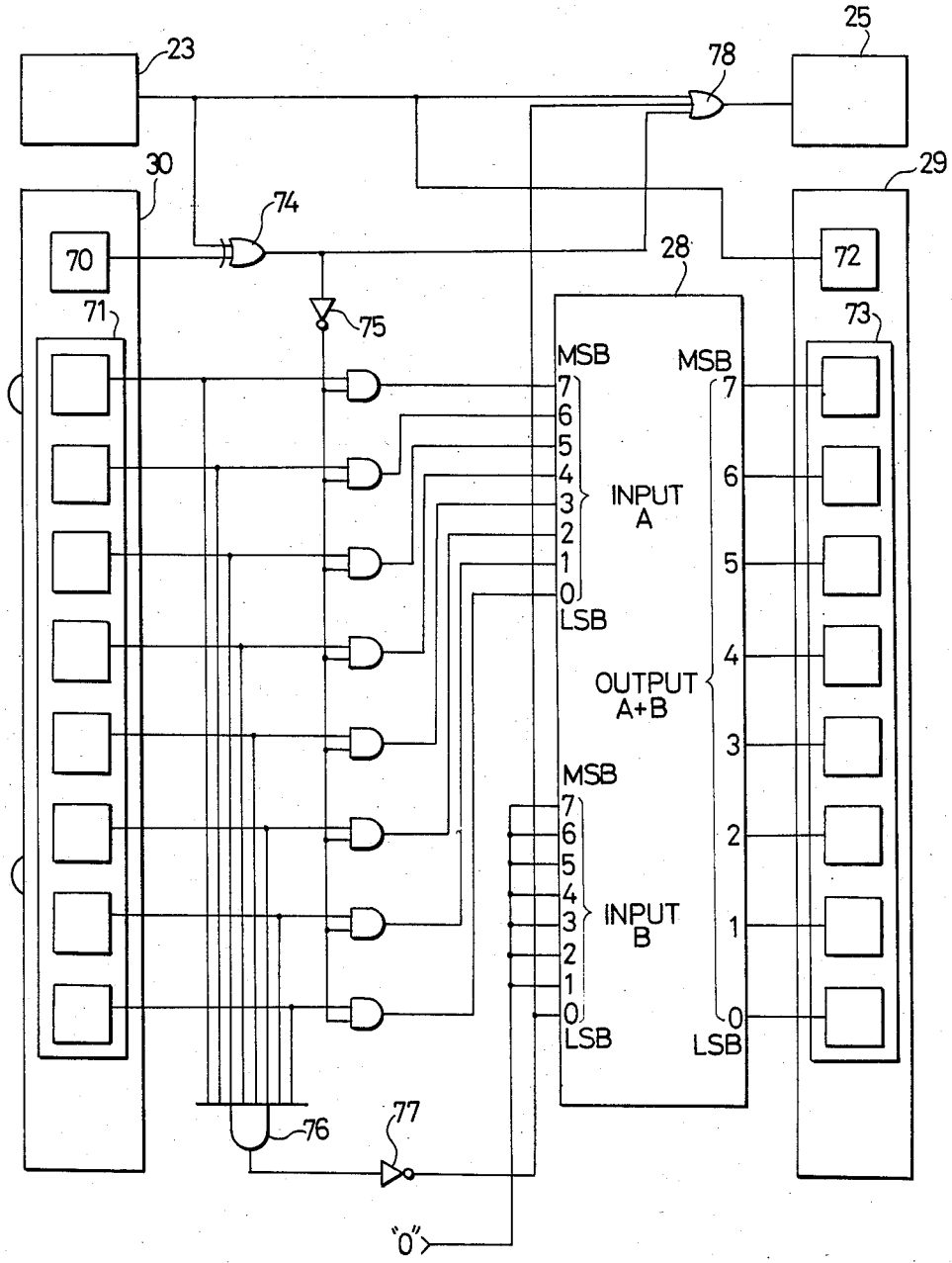
FIG. 11 is a circuit diagram illustrating a specific operative example of the chattering preventing operation processing block including a control circuit 24 in FIG. 4.

FIG. 11 is a circuit diagram illustrating a specific arrangement of the chattering prevent operation processing block including the control circuit 24 shown in FIG. 4. Reference numeral 23 indicates a first memory for temporarily storing the first or second switch detection signal, 25 a memory for temporarily storing the output signal of the first memory 23 and a switch status output signal having chattering removed by the control circuit 24, 30 a fifth memory for temporarily storing a signal on the data bus and supplying it to the control circuit 24, 28 an adder for adding the output signal of the control circuit 25, and 29 a gate circuit for performing predetermined bit operations for the output signals of the adder 28 and the control circuit 24 and providing them on the data bus. Now let it be assumed that the chattering prevent operation is carried out using eight-bit data. The fifth memory 30 includes an eight-bit thirteenth memory 71 which temporarily stores chattering prevent operation parameter data and supplies it to the control circuit 24, and the gate circuit 29 includes an eight-bit fifth gate circuit 73 which provides the chattering prevent operation parameter data on the data bus. Furthermore, a fourteenth memory 70 which temporarily stores previous key switch information and supplies it to the control circuit 24 and a sixth gate circuit which provides new key switch information on the data bus are also provided.

Figure 12:
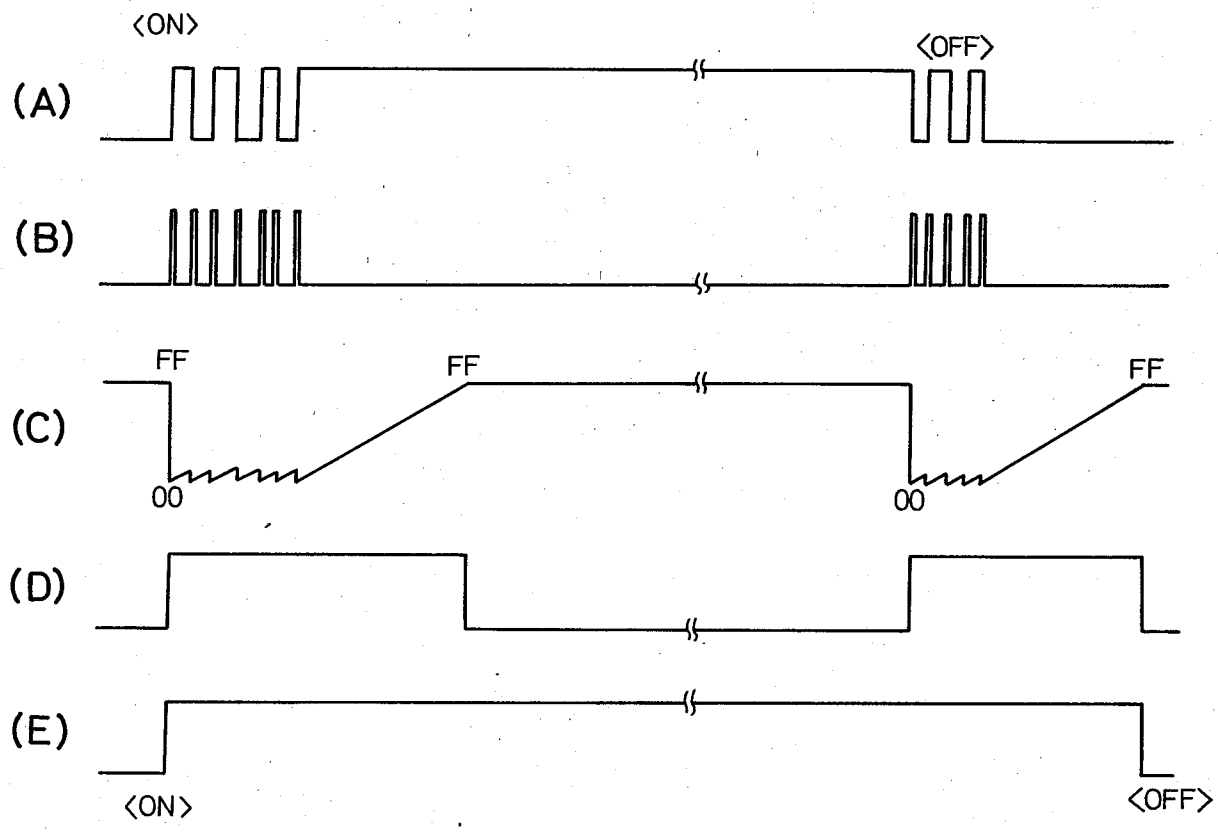
FIGS. 12A to 12E are signal diagrams for explaining the operation of the circuit arrangement depicted in FIG. 11.

A description will be given, with reference to FIG. 12, of the operation of the circuit arrangement depicted in FIG. 11. A keyboard switch signal which is input by a keyboard actuation from a certain keyboard switch via the first memory 23 generally includes chattering noise in either of an ON event and an OFF event and are not only inappropriate as a key status signal of an electronic musical instrument but also causes a large error in the touch response detection. The output signal of the first memory 23 is applied to an exclusive-OR gate 74, along with the output signal of the fourteenth memory 70, and as a result of this, such an event start signal as shown in FIG. 12B is applied to an OR gate 78 and in inverter 75. The output signal of the inverter 75 is applied as a reset signal to each of AND gates which are each provided for each bit of the thirteenth memory 71. In consequence, eight-bit chattering prevent operation parameter data is cleared for each occurrence of the abovesaid event start signal, as shown in FIG. 12C, and this data is provided as a first input to the adder 28. On the other hand, each bit output of the thirteenth memory 71 is such a signal as shown in FIG. 12D which goes to a "0" only when the chattering prevent operation parameter data is in an all-one state, and it is provided as the least significant bit of the second input of the adder via an AND gate 76 and an inverter 77. Since the other bits of the second input of the adder 28 are all held at the "0" level, the adder 28 is set to always increments the chattering prevent operation parameter data unless the data value assumes the maximum value. With such an arrangement, the chattering prevent operation parameter data varies, as shown in FIG. 12C, and this increment characteristic can easily be rendered to a desired time characteristic by setting a desired constant as the second input of the adder 28. As a result of the above operations, the output signal of the inverter 77, shown in FIG. 12D, the event start signal of FIG. 12B and the keyboard switch signal of FIG. 12A are applied to the OR gate 78, providing therefrom such an output signal as shown in FIG. 12E. This is to response to the occurrence of an ON-event of the keyboard switch signal to detect, as an ON-event output, a first event including chattering, and to respond to the occurrence of an OFF event to detect, as an OFF-event signal, a certain period of time after the last event including chattering. Thus, letting the time in which the chattering prevent operation parameter data is incremented from its initial to maximum value be represented by T, chattering within the time T is masked with respect to the ON event of the keyboard switch signal, always detecting the first ON event. With respect to the OFF event of the keyboard switch signal, chattering within the time T is masked and when the keyboard switch remains in the OFF state for more than the time T, it is detected as an OFF event. Conditions for determining the time parameter T for masking chattering are arbitrary constants which as set as the time sharing rate of the chattering prevent operation, the number of bits of the chattering prevent operation parameter data, the second input of the adder 28 and so forth. A time constant in the range of from 10 to 20 ms, which is used as a chattering eliminating timer in a software scanning system, can easily be implemented. With the provision of the chattering preventing circuit which can be time-shared with the touch response detect operation processing circuit, as mentioned above, an effective chattering preventive effect can be produced through use of a simpler circuit arrangement than in the case of providing a circuit for each key or a dedicated circuit as in the past. Furthermore, the chattering preventing circuit according to the present invention permits very high precision setting of the time parameter T, operates stably and at a high speed, as compared with a conventional analog type chattering preventing circuit utilizing a time constant circuit or the like.

Figure 13:
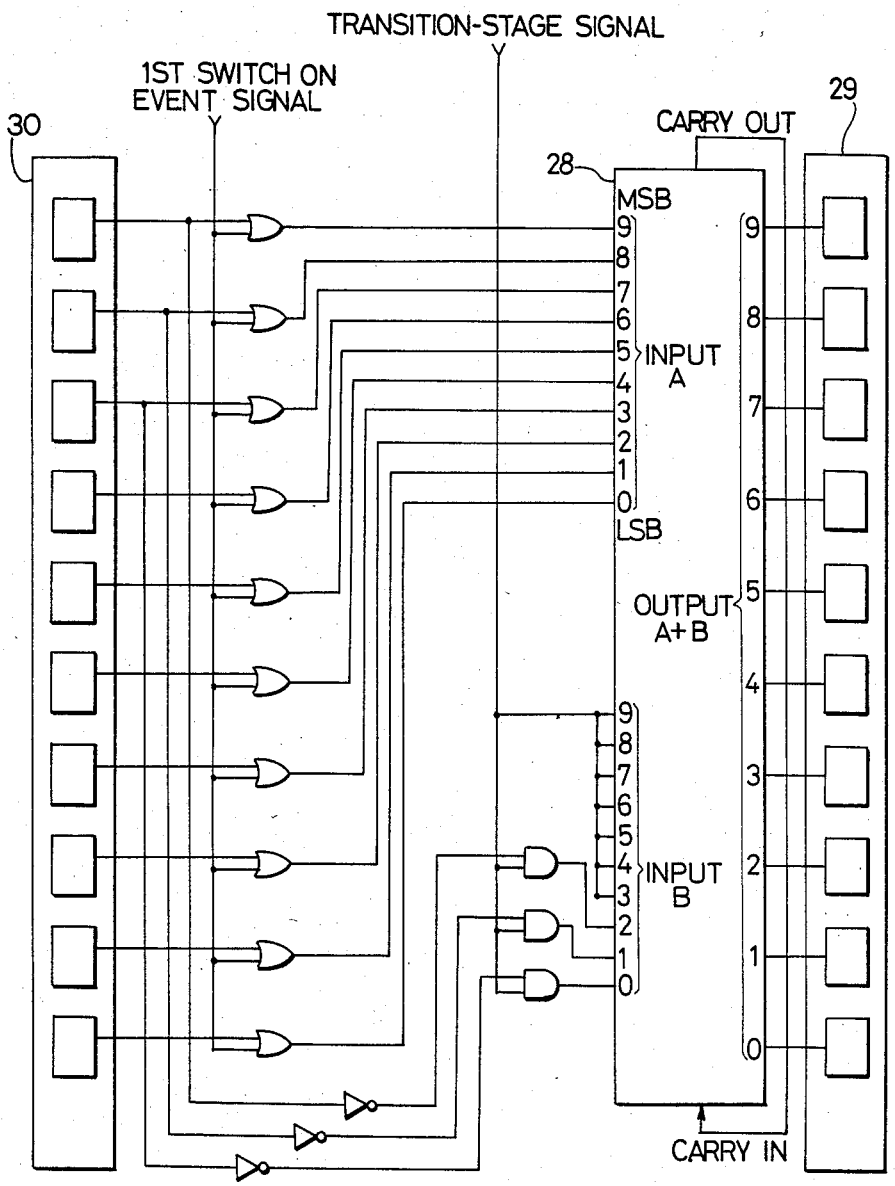
FIG. 13 is a circuit diagram illustrating a specific operative example of the touch response detecting operation processing block including the control circuit 24 in FIG. 4.

FIG. 13 illustrates an embodiment of a specific arrangement of the touch response detect operation processing block including the control circuit 24 shown in FIG. 4. Reference character (b) indicates an ON-event signal of the first switch which is produced by such a circuit operation as described previously in connection with FIG. 6, an (c) a transition-stage signal which is similarly generated by the circuit operation mentioned with respect to FIG. 6, that is, a signal representing the time interval between the ON event of the first switch and thde ON event of the second switch. Reference numeral 30 designates a fifth memory for temporarily storing a signal on the data bus and supplying it to the control circuit, 28 an adder for adding the output signal of the control circuit, and 29 a gate circuit which performs predetermined bit operations for the output signals of the adder 28 and the control circuit 24 and providing them on the data bus. This embodiment is arranged to perform the touch response detect operation using 10-bit data, so when the data bus is eight-bit, the data transfer is effected in two stages on the time-shared basis.

Figure 14:
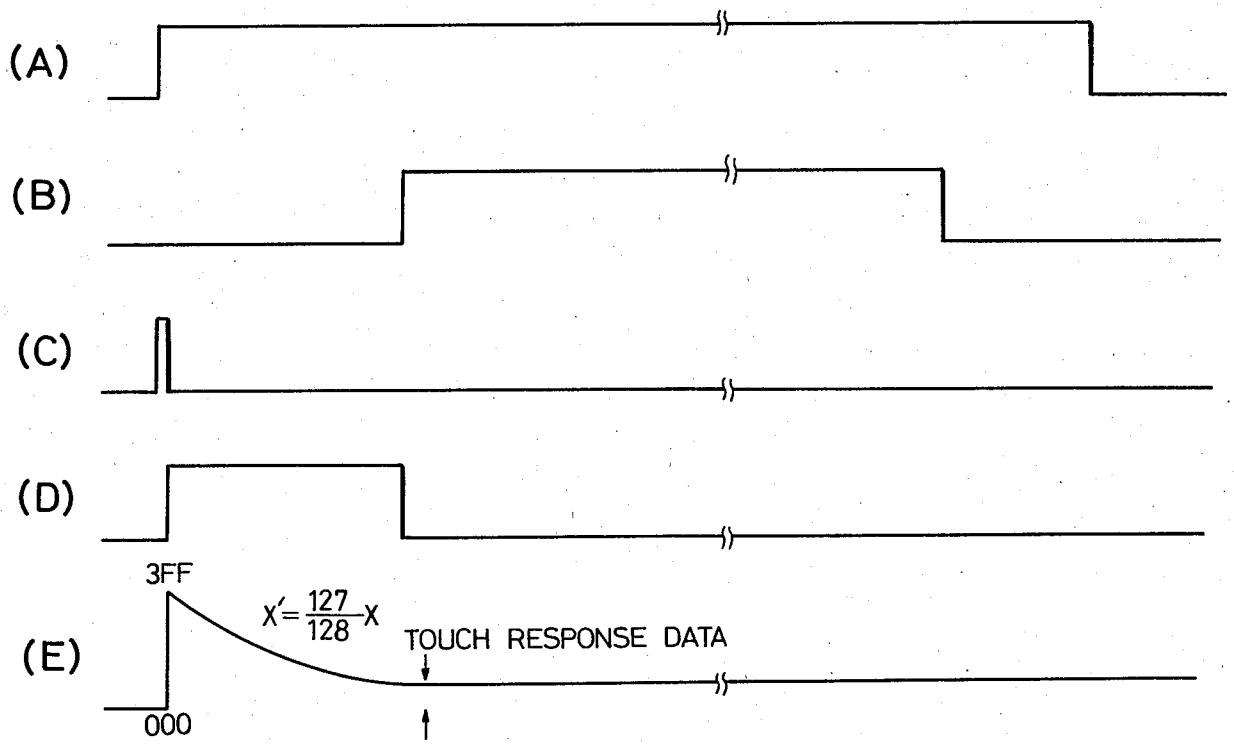
FIGS. 14A to 14E are signal diagrams for explaining the operation of the specific operative example shown in FIG. 13.

Turning now to FIG. 14, the operation of the circuit arrangement shown in FIG. 13 will be described. The key status signal of the first switch input by a keyboard actuation and subjecte to chattering prevent operation processing becomes as shown in FIG. 14A, and the key status signal of the second switch of the same keyboard subjected to the chattering prevent operation processing is as shown in FIG. 14B. The signal (b) in FIG. 13 which is produced in response to the key switch signal is an ON-event signal of the first switch created by the circuit operation described previously in respect to FIG. 6, and becomes active at the rise of the key status signal of the first switch, as shown in FIG. 14C. On the other hand, the signal (c) in FIG. 13 is a transition-stage signal, that is, a signal representing the time intervale between the ON-event of the first switch and the ON-event of the second switch, and it becomes active at the rise of the key status signal of the first switch and inactive at the rise of the key status signal of the second switch, as depicted in FIG. 14D. Now consider an example of the touch response detect operation corresponding to one keyboard. A 10-bit touch response detect operation parameter signal which is supplied via the fifth memory 30 from the data bus on the time-shared basis is input to OR gates each provided for each bit, and as the other input to the OR gate, the ON-event signal of the first switch is supplied in common. In consequence, the touch response detect operation parameter signal has its all bits initialized to ones at the point of the ON event of the first switch, and this data is applied as the first input to the adder 28. On the other hand, three high-order bits of the touch response detect operation parameter signal are respectively applied via inverters to AND gates, the outputs of which are shifted seven bit positions and provided to three low-order bits of the second input of the adder 28. As another input of each of the AND gates, the transition-stage signal is applied in in common to them to provide gate signals, and the transition-stage signal is supplied as the remaining high-order bits of the second input of the adder 28. Thus the signal which is applied as the second input to the adder 28 is such a 10-bit data that while the transition-stage signal is active, that is, during the touch response detect operation, the three high-order bits of the touch response detect operation parameter signal are inverted and shifted seven bit positions to the three low-order bits and the remaining high-order bits are all made ones. On the other hand, while the transition-stage signal is inactive, that is, in the operation phase in which no touch response detect operation takes place, all the bits of the abovesaid 10-bit data go to zeros, permitting the first input to the adder 28 to pass therethrough as its output signal. Now consider the touch response detect operation parameter signal output which is derived from the adder 28 by such data translation processing. Letting X stand for the touch reponse detect operation parameter signal input data and Y stand for the number of the three bits obtained by shifting the three high-order bits of the input X seven bit positions, the Y is approximately one-(seventh power of two)th of the X, that is, $$Y \approx X/128 \tag{1}$$

and since the X and the Y are both integers with no sign bits, $$X > Y \tag{2}$$

Furthermore, it is well-known, in general, that letting "one's complement" of a certain number Y be represented by $\overline{Y}$, if the Y is 10-bits, then $$\overline{Y} = 2^{10} - 1 - Y \tag{3}$$

Incidentally, since one's complement is a number obtained by inverting all bits of a certain number, the second input to the adder 28, i.e. the 10-bit data obtained by inverting the three high-order bits of the touch response detect cperation parameter signal and shifting them seven bit positions to the three low-order bits and by setting all the remaining high-order bits to ones, exactly bears a relationship of the one's complement to the $\overline{Y}$ which is the number of the three bits obtained by shifting the three high-order bits of the X seven bit positions. Therefore, the first input to the adder 28 is the X that is the touch response detect operation parameter. On the other hand, since the second input to the adder 28 is its $\overline{Y}$, if the result of the add operation is taken as X', then it follows from Eq. (3) that $$X' = X + \overline{Y} = 2^{10} + (X - Y) - 1 \tag{4}$$

From Eq. (2), $$X -> 0 \tag{5}$$

so Eq. (4) causes an overflow in 10 bits, and one's complement in the addition is corrected, resulting im Eq. (4) becoming as follows;

$$X' = X + \overline{Y} = X - Y \tag{6}$$

In consequence, the adder 28 performs a subtraction of the Y from the X. Here, from Eq. (1), it follows that $$X' \approx X - X/128 = (127 * X)/128 \tag{7}$$

Therefore, $$X' \approx (127/128) * X \tag{8}$$

This means that the touch response detect operation parameter signal data X is always multiplied by a positive constant (127/128) which is smaller than one. This multiplication causes the touch response detect operation parameter signal data to vary at a fixed rate. When the second switch is put in the ON state and the transition-stage signal becomes inactive, that is, when the process proceeds to the operation phase in which to stop the touch response detect operation, all the bits of the second input to the adder 28 go to zeros, permitting the first input to the adder 28 to pass therethrough as an output signal thereof, and the touch response detect operation parameter signal data at this point is held as it is and continues to be subjected to a plus "0" add operation. The touch response detect operation parameter signal data thus obtained is appropriately transferred via the data bus to the sixth memory 31, the control circuit 34 and the tone generator 5. Eventually, the data is reflected as a musical parameter which is created by the tone generator 5. Data such as, for instance, a peak value of volume, the form of an envelope, a sustain time, a harmonic structure, a temporal variation characteristic of timbre, a tone filter characteristic and so forth, are set to correspond to the touch response value. By such touch response detect operation processing as described above, the touch response detect operation parameter varies describing such a natural exponential event curve as shown in FIG. 7A, providing excellent musical instrument characteristics. What is important here is that the touch response detect operation processing can be accomplished through use of an adder common to the chattering prevent operation processing, without the necessity of using complex circuits which are conventionally needed for obtaining the abovesaid characteristics, such as a multiplier circuit, an exponential function translation table and so on, that is, effective musical instrument characteristics can be obtained with a simple circuit arrangement. While in the above such a multiplication parameter as indicated by Eq. (8) is obtained by a seven-bit shift, desired conversion characteristics can similarly be set with ease, for example, (63/63) by a six-bit shift, (31/32) by a five-bit shift, etc. Moreover, although in the above the touch response detect operation parameter is processed with a 10-bit precision as a whole, it is possible to achieve such high precision touch reponse detect operation processing by using 12 bits, 14 bits, . . . Additionally, according to the conventional system employing a touch response counter, since the counter overflows when the key striking speed is very low, a set value comparator and a count stop circuit are needed for stopping the counter form counting when a certaim set value is reached. In contrast thereto, according to the abovedescribed system of the present invention, when the three high-order bits of the touch response detect operation parameter signal which are shifted all go to zeros, the add operation automatically becomes the "plus "0" add operation", by which the touch response detect operation parameter signal data is retained unchanged and a certain minimum value is automatically set. Also in this point, effective instrument characteristics can be obtained with a simple circuit arrangement.

Figure 15:
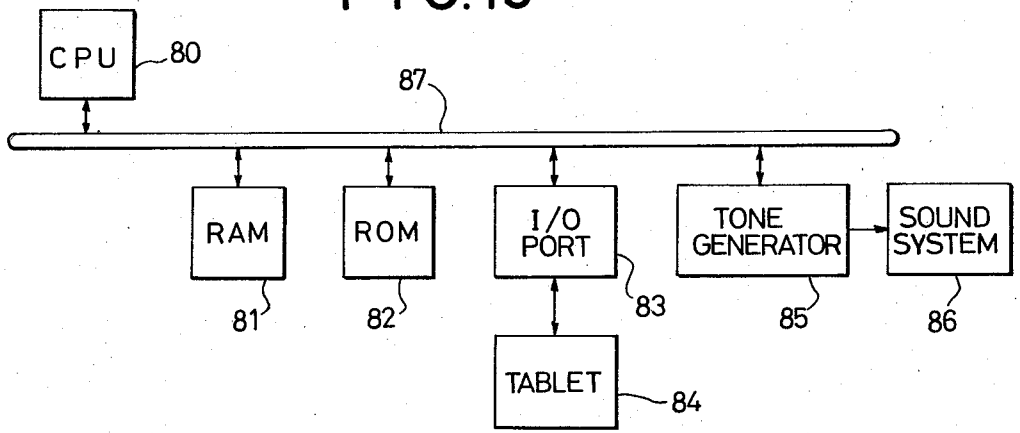
FIG. 15 is a block diagram showing an example of the arrangement of a conventional musical tone generator including a CPU.

The touch response data obtained as described above is utilized by the tone generator including the CPU so that it is reflected in parameters such as the volume, timbre, temporal variations and so forth of the musical tone to be created. This calls for continual transfer of the touch response data from the touch response detect processing block to the musical tone generating block. In this case, the amount of data to be transferred is so large that according to the transfer system used, the processing speed becomes so low as to be insufficient as an electronic musical instrument. In other words, an efficient transfer system is required which corresponds to the characteristics of the system. The present invention also proposes a novel and efficient touch response data transfer system which is suitable for use with the above-described system of the present invention. FIG. 15 illustrates in block form a conventional arrangement of the musical tone generator including a CPU. In FIG. 15, reference numeral 80 indicates a CPU for controlling the entire circuit, 81 a RAM for temporarily loading data or the like, 82 a ROM for loading fixed data, program and so on, 83 an I/0 port, 84 a tablet for setting timbre, effect or the like, 85 a tone generator, 86 a sound system and 87 a system bus including an address bus, a data bus, a control bus and the like. The electronic musical instrument of such an arrangement is well-known in the art, and hence will not be described in detail. In such a system the respective parts are placed under control of the CPU 80, which executes all processes from the actuation of keyboards to the generation of musical sounds in accordance with programs stored in the ROM 82, and the operating speed of the circuit are dependent largely upon the processing speed of the CPU 80 and the efficiency of software used.

Figure 16:
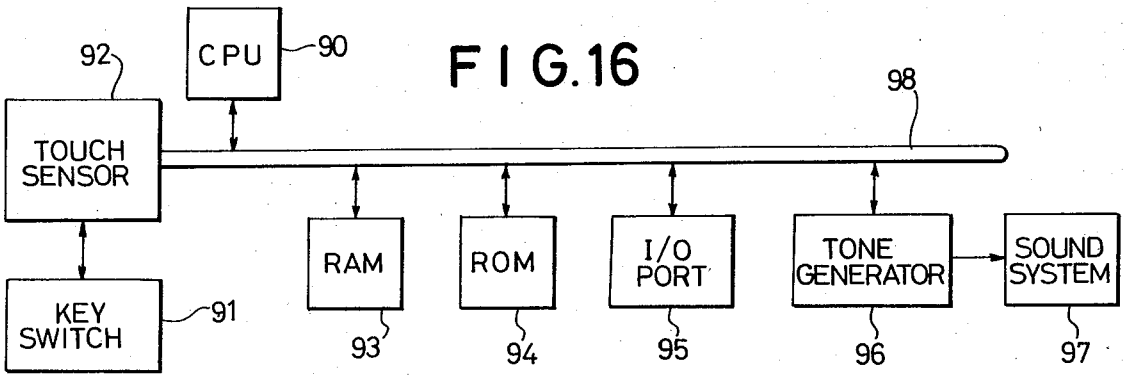
FIG. 16 is a block diagram showing an example of the additional provision of a touch response processing block in the conventional musical tone generator depicted in FIG. 15.

FIG. 16.illustrates an example in which a touch response processing block is added to the conventional arrangement of the musical tone generator depicted in FIG. 15. In FIG. 16, reference numeral 90 indicates a CPU for controlling the entire circuit, 93 a RAM for temporarily storing data or the like, 94 a ROM for storing fixed data, program and so forth, 95 an I/0 port, 96 a tone generator, 97 a sound system, 98 a system bus including an address bus, a data bus, a control bus and so on, 91 a keyboard switch and 92 a touch sensor for creating touch response data. Such a circuit arrangement seems to operate without any problems, but the touch sensor 92 is not an element which is completely placed under control of the CPU 90 like the other elements, but is an element which performs its internal operation at a far higher speed than does the CPU 90 and processes a large quantity of data on a realtime basis. Therefore, an electronic musical instrument with an effective touch response function cannot be implemented simply by connecting the touch sensor as shown in FIG. 16. That is to say, touch response data from the touch sensor 92 is provided in real time via the system bus 98 to the musical tone generating block including the CPU 90, and in this case, the system bus 98 is temporarily occupied by the transfer of the touch response data. On the other hand, the system bus 98 is used by the CPU 90 substantially at all times for a data transfer, a status detection, an input/output operation, tone generator control and so .forth as well as for fetching an instruction from the ROM 94. Accordingly, a mere additional provision of the touch response processing block in the arrangement of FIG. 17 will cause a bus fight, double access and similar imconveniences, failing to achieve satisfactory circuit operations. Moreover, the operating time for the touch sensor 92 to perform the touch response detect operation of one key is far shorter than the operating time necessary for the CPU 90 to execute one process. It is therefore necessary to set an appreciable amount of time for occupying the system bus for transferring the touch response information, or to employ a data transfer system of as high efficiency as possible.

Figure 17:
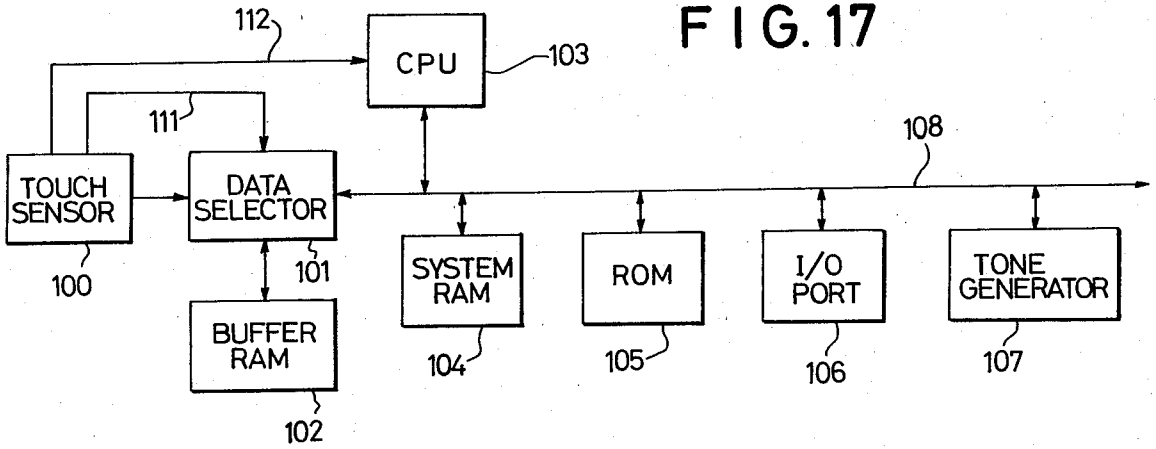
FIG. 17 is a block diagram showing a specific arrangement of a possible system for the transfer of touch response data.
Figure 18:
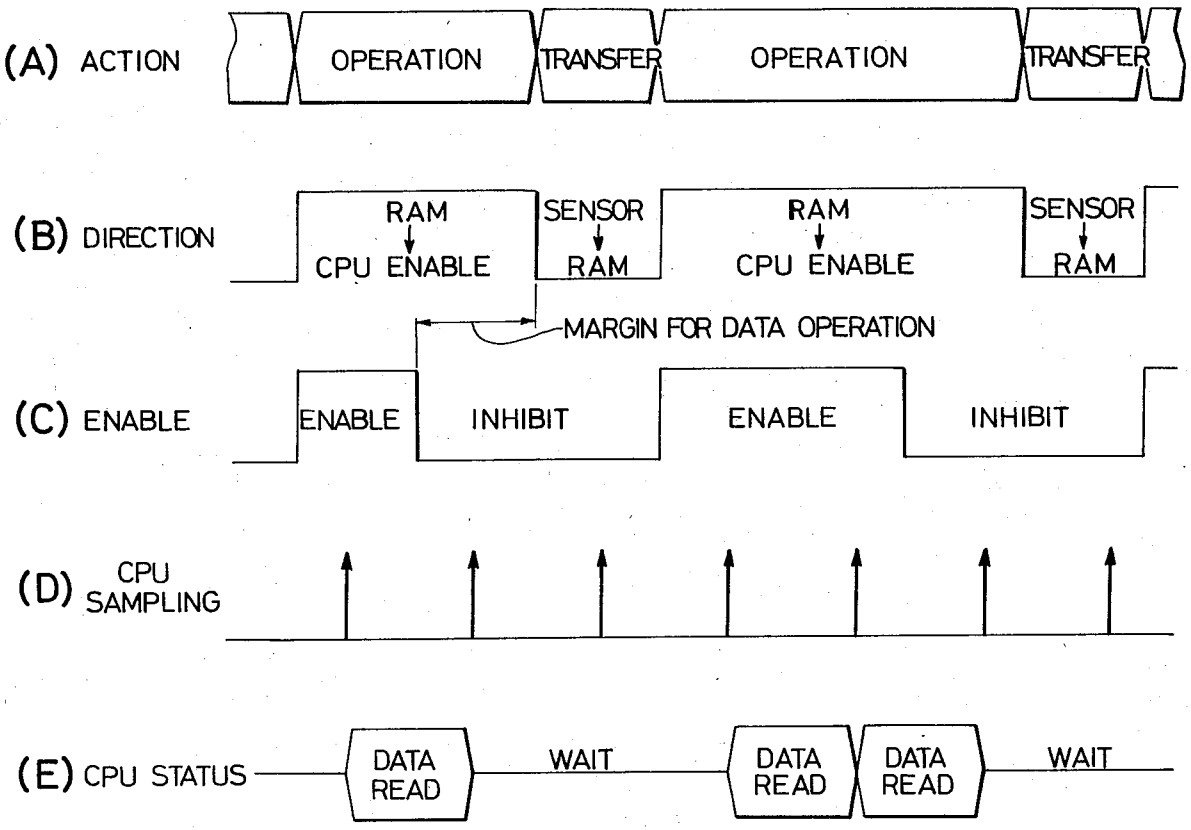
FIGS. 18A to 18D are diagrams for explaining the operation of the arrangement shown in FIG. 17.

FIG. 17 illustrates a specific operative example of a possible system for such a touch response information transfer. In FIG. 17 reference numeral 100 indicates a touch sensor which creates touch response data, 101 a data selector for switching data on the data bus, 102 a buffer RAM for temporarily storing the touch response data, 103 a CPU for controlling the entire circuit, 104 a system RAM for temporarily storing data and the like for system operations, 105 a ROM for storing fixed data, programs and so forth, 106 an I/0 port, 107 a tone generator, and 108 a system bus including an address bus, a data bus, a control bus and so on. Turing next to FIG. 18, the operation of this system will be described. FIG. 18A shows the operation mode of the touch sensor 100. In this case, the operation mode for performing the touch response detect operation and the transfer mode for transferring the touch response data to the buffer RAM 102 are laternate with each other. This can be achieved not only by a system in which the two modes repeats regularly bot also by a system in which the operation mode is switched upon occurrence of a key striking event. FIG. 18B shows a direction signal 111 which is provided from the touch sensor 100 to the data selector 101, by which in the operation mode in which the touch sensor 100 conducts the touch response detect operation, the data bus in the system bus 108 is disconnected from the touch sensor 100 so that the buffer RAM 102 is accessible from the CPU 103 and, in the transfer mode in which the touch sensor 100 transfers the touch response data to the buffer RAM 102, the data bus in the system bus 108 is disconnected from the CPU system so that the buffer RAM 102 is accessible from the touch sensor 100. What is important here is that since the direction signal 111 is supplied from the touch sensor 100 asynchronously with the operation of the CPU 103, it happens that, in the transfer mode, the touch sensor 100 accesses the buffer RAM 102 at desired timing for transferring thereto the touch response data, whereas the CPU is sometimes forced to wait until the timing condition is satisfied when it is necessary to receive the data while verifying that the buffer RAM 102 is accessible. It will be seen that when the CPU 103 decides the signal of FIG. 18B as an access enable signal for the buffer RAM 102, if it happens to sample the "operation mode" immediately before the transfer mode, a contention for the address bus will occur at the immediately following mode switching time and that the signal of FIG. 18B cannot be used, in the illustrated form, as an access enable signal for the buffer RAM 102. On account of this, the touch sensor 100 separately produces such an enable signal as shown in FIG. 18C and provides it to the CPU 103. FIG. 18D shows an example of the operation of the CPU 103 for sampling the above signal; As a result of this, the CPU 103 performs such a touch response data readout operation as depicted in .this method is not necessarily FIG. 18E. However, satisfactory for an efficient data transfer in real time.

Figure 19:
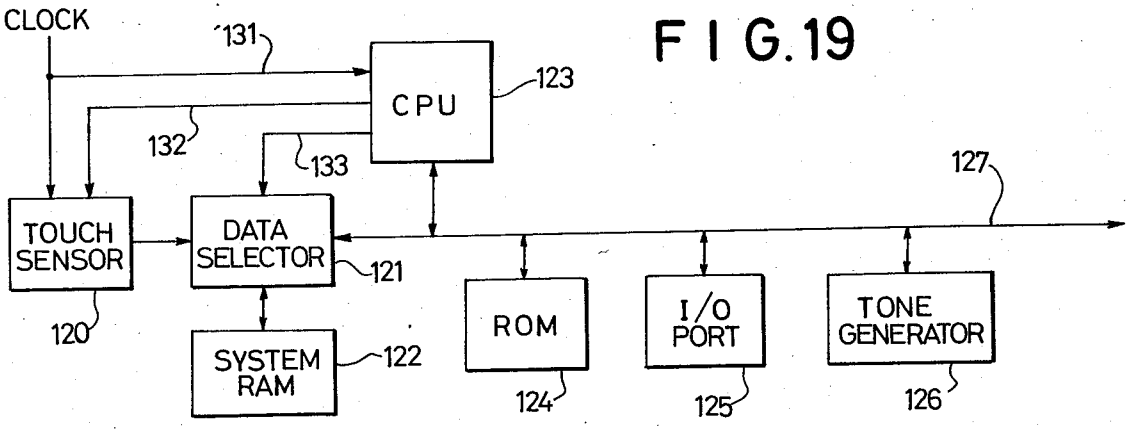
FIG. 19 is a block diagram illustrating another specific arrangement for the transfer of touch response data.
Figure 20:
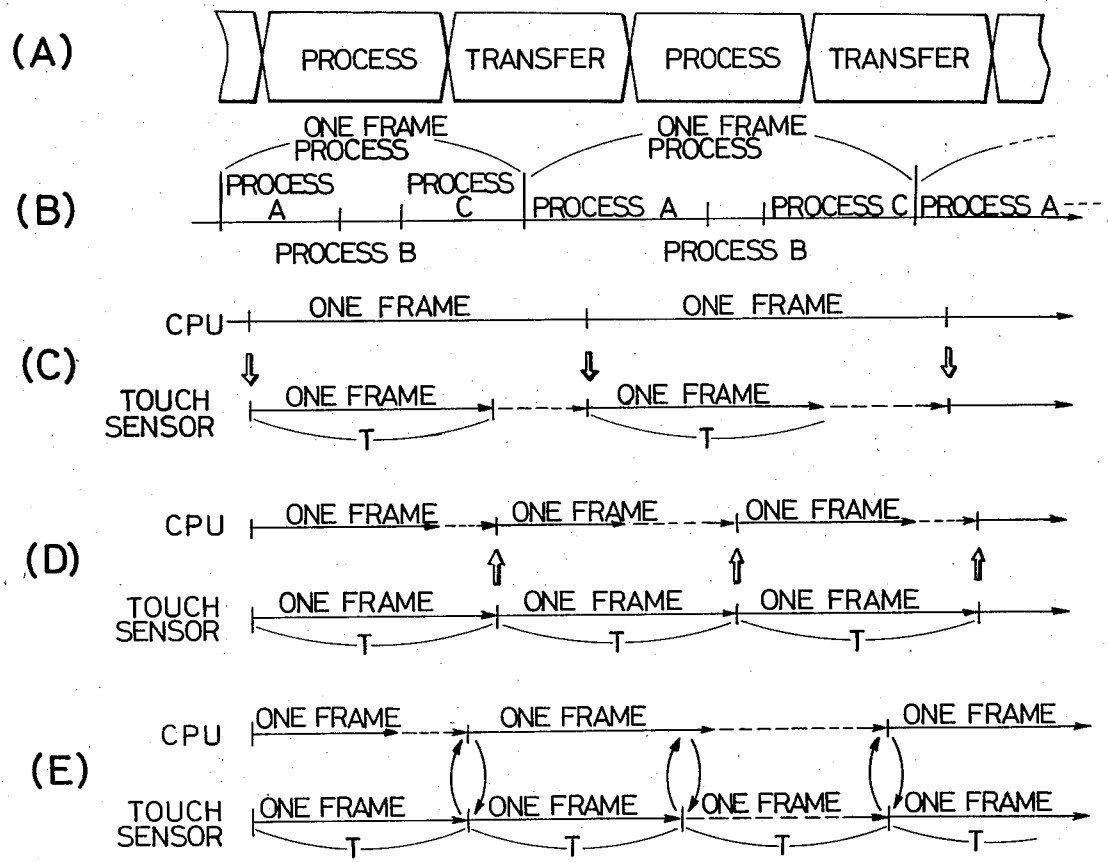
FIGS. 20A to 20E are diagrams for explaining the operation of the arrangement shown in FIG. 19.

FIG. 19 illustrates the arrangement of another system as an alternative for the above touch response information transfer system. In FIG. 19 reference numeral 120 indicates a touch sensor which creates touch response data, 121 a data selector for switching data on the data bus, 123 a CPU for controlling the entire circuit, 122 a system RAM for temporarily storing touch response data and data for system operations, 124 a ROM for storing fixed data, programs and so on, 125 an I/O port, 126 a tone generator, and 127 a system bus including an address bus, a data bus, a control bus, etc. It is assumed to use, as the CPU 123, for example, 6809E-CPU by Motorola which is capable of intermittetly using a bus. The operation of the circuit arrangemnent of FIG. 19 will be described with referennce to FIG. 20. A common clock signal 131 is provided to the touch sensor 120 and the CPU 123, the both of which basically use the bus for the touch response data at synchronized timing. That is, the system RAM 122 on the system bus of the CPU 123 is shared with the touch sensor 120, and in a phase in which the system bus 127 can be used, the touch sensor directly transfers the touch response data without applying it to the buffer RAM. FIG. 20A show, by way of example, the state of use of the system bus 127. In its bus occupying cycle the CPU 123 performs such operations as a program fetch, a memory access, an input/output operation and so forth, and in its bus non-occupying cycle it carries out such internal operations as the decoding of an instruction, an operating manipulation, a register operation, etc. besides it enables the touch sensor 120 to transfer data to the RAM. Such a system appears to be efficient, but the tone generator including the CPU and the touch sensor essentially differ not only in operating speed but also in the factor to the fluctuation in the amount of data to be processed and further, they primarily operate asynchronously unless either one of them is delayed to be timed with the other. Accordingly, the circuit arrangement of FIG. 19 does not always operate efficiently simply by providing the touch sensor unconditionally. FIG. 20B is explanatory of the above. Processing by the CPU 123 includes a lot of work such as the generator assignment from the keyboard state, the specification of a pitch, the triggering of an envelope, etc. In FIG. 12B they are represented by processes A, B and C, which are shown to be executed in one frame. Now consider the amount of data to be processed by the processes A, B and C. The total amount of work apparently undergoes a substantial change with the key-depressed state, and a result of this, the time for the processing in one frame increases or decreases in accordance with the condition of each operation. Therefore, the processing by the CPU 123 is considered as time-sharing operations of unequal intervals in terms of one-frame units. In constrast thereto, the processing time of one frame by the touch sensor 120 which is defined by (processing time)×(the number of keyboards) is free from a factor to variations, and hence is always constant. In terms of one-frame units, the processing by the touch sensor is considered as time-sharing operations of equal intervals, and the touch sensor essentially operates asynchronously with the CPU 123. FIG. 20C shows, by way of example, operation flows of the two blocks which primarily operate asynchronously. In this example, one frame of the touch sensor 120 is shorter than the shortest processing time of the CPU 123, and after the touch sensor 120 has completed processing of one frame, it is essentially placed in the wait state for the rest of the cycle. That is, in the bus non-occupying cycle by the CPU in FIG. 20A, there is no more effective work to be done by the touch sensor 123 in the above frame, resulting in the rest of the cycle becoming a loss time which decreases the efficiency of the system. FIG. 20D shows another example in which one frame of the touch sensor 120 is longer than the longest processing time of the CPU 123. In this instance, after having its processing of one frame, the CPU 123 essentially stays in the wait state for the rest of the cycle. That is, in the bus occupying cycle by the CPU shown in FIG. 20A, there is no more effective work to be done by the CPU 123 in this frame and the rest of the cycle becomes a loss time which degrades the efficiency of the system. FIG. 20E shows another example in which the processing time of one frame of the CPU 123 and the processing time of one frame of the touch sensor 123 are substantially equal. This method also appears to be efficient but defective in practical use, as described below. When it happens that the touch sensor enters the "wait" state at the end of its frame although the CPU has not yet completed its processing in this frame, even if the CPU completes its processing, the next frame becomes a dummy phase in which neither of the CPU 123 and the touch sensor 120 performs any effective operations, resulting in a loss time which decreases the efficiency of the system. Thus this example is not always satisfactory, either, for efficiently transferring data in real time.

Figure 21:
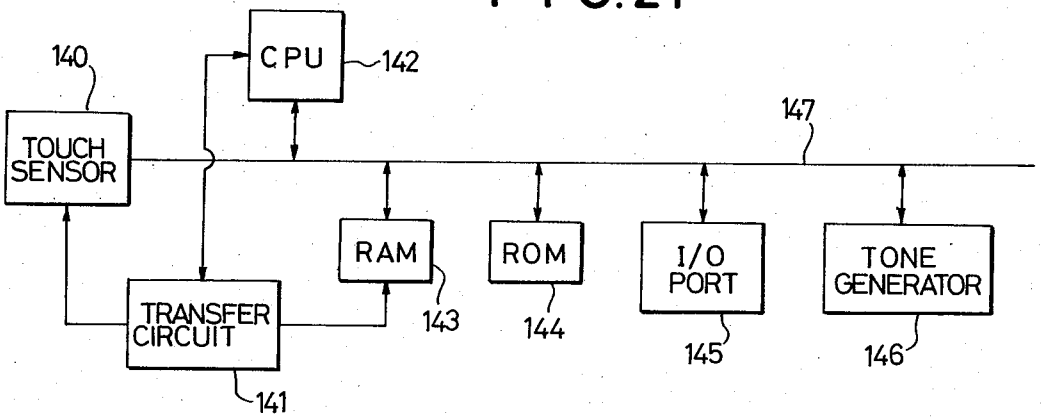
FIG. 21 is a block diagram illustrating a specific arrangement of an effective data transfer system from a touch sensor to a CPU system according to the present invention.

With such a background, the present invention is to propose, as a system combined with the chattering prevent/touch response detect system of the present invention, a system which permits an efficient data transfer from the touch sensor to the CPU system. More specifically, the present invention is to provide two different data transfer systems as a system which is combined with the chattering prevent/touch response detect system of the present invention. FIG. 21 is a conceptual diagram illustrating an example of its specific system arrangement. In FIG. 21 reference numeral 140 a touch sensor which creates touch response data, 141 a transfer circuit for controlling a data transfer, 142 a CPU for controlling the entire tone generator, 143 a system RAM for temporarily stores data concerning system operations, 144 a ROM for storing fixed data programs and so forth, 145 and I/0 port, 146 a tone generator, and 147 a system bus including an address bus, a data bus, a control bus, etc. By the provision of the transfer circuit 141 for controlling the data transmission and reception between the touch sensor 140 and the CPU 142, a data transfer is implemented which does not impair the performance of the system. In this case, two kinds of systems are possible according to which of the touch sensor 140 and the CPU 142 issues a data transfer request signal to the transfer circuit 141 to proceed to the transfer mode. One is a system in which the touch sensor 140 provides a data transfer request signal, and in this case, if such a transfer method is used that involves checking of the state of the data receiving block, as referred to previously, frame synchronization will cause great loss of time. The other system is one that the CPU 142 produces the transfer request signal, and in this case, to essentially synchronize the frames through the buffer RAM will also cause great loss of time. Accordingly, it is necessary to employ such a data transfer system that is combined with the chattering prevent/touch response detect system of the present invention and is suitable for use therewith in terms of circuit arrangement and circuit operation and permits an effective data transfer without enlarging the circuit scale.

Figure 22:
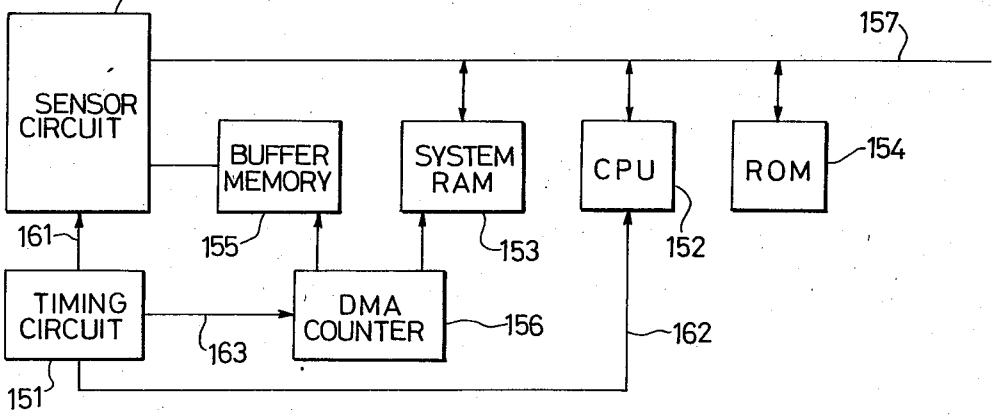
FIG. 22 is a block diagram illustrating, as a first example for implementing the data transfer a specific arrangement of a transfer circuit 141 and circuits associated therewith in FIG. 21.
Figure 23:
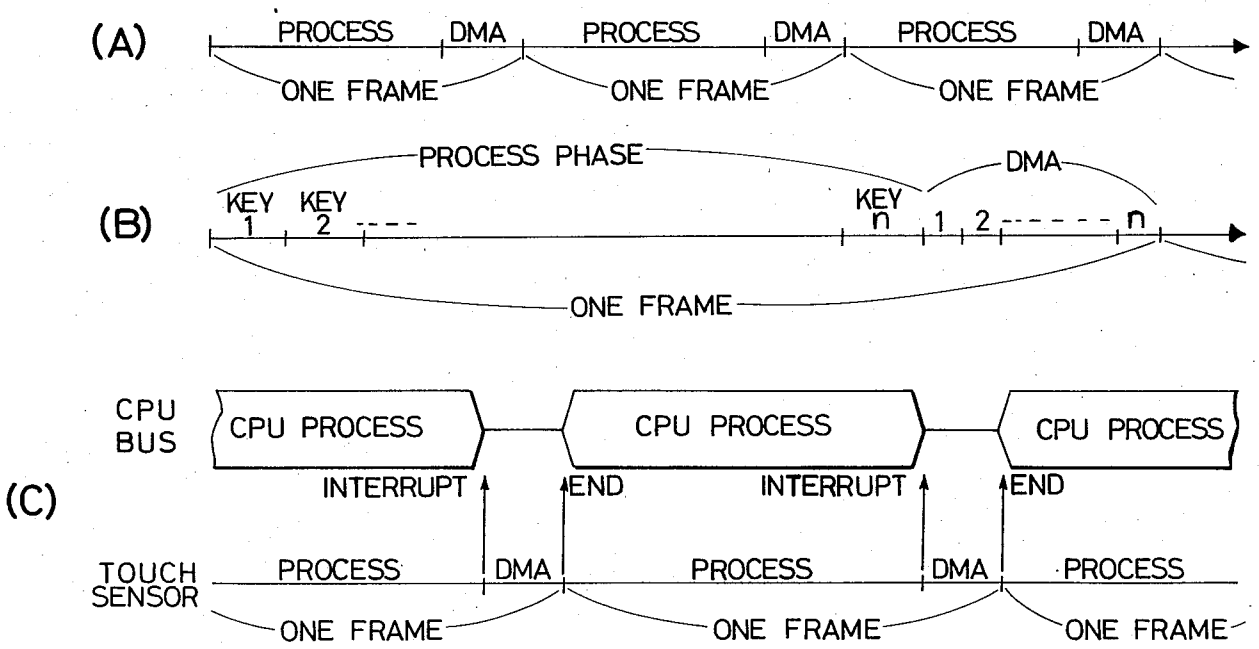
FIGS. 23A to 23C are diagrams for explaining the operation of the arrangement shown in FIG. 22.

FIG. 22 illustrates, as a first example of such a data transfer system, a specific arrangement of the transfer circuit 141, including circuits associated therewith. Reference numeral 150 indicates a touch sensor which generates touch response data, 151 a timing circuit in the touch sensor 150, 152 a CPU for controlling the entire tone generator, 153 a system RAM for temporarily storing the touch response data and data concerning system operations, 154 a ROM for storing fixed data, programs and so on, 155 a buffer memory in the touch sensor 150, 156 a DMA counter, and 157 a system bus including an address bus, a data bus, a control bus, etc. Turning next to FIG. 23, the operation of this circuit arrangement will be described. In the touch sensor 150, as shown in FIG. 23A, one frame is divided into two, i.e. a first phase in which to effect necessary touch response detect processing (including chattering prevent processing) for al1 keys and a second phase in which to effect the DMA (Direct Memory Access) transfer of the touch response data of all the keys to the system RAM 153. The operations of these two phases are performed in succession at timing unique to the touch sensor 150. FIG. 23B shows this in more detail. In the first phase for the touch response detect processing (including the chattering prevent processing), processing for each keyboard takes place in order KEY1, KEY2, . . . and KEYn. Assuming that processing of 61 keys is effected taking, for instance, 1 μsec for chattering prevention and 1 μsec for touch response detection for each key, the first phase consumes 122 μsec. Assuming that after the first phase, the DMA transfer of the touch response data is carried out by the DMA counter 156 similarly in order KEYI, KEY2, . . . and KEYn and that the data transfer is carried out for 61 keys taking 250 nsec fdr each key, the second phase consumes 15.25 μsec. It is the feature of this data transfer system that the execution time of one frame is repeated at fixed time intervals on the basis of the timing peculiar to the touch sensor, presenting the transfer request entirely regardless of the operation of the CPU. FIG. 23C shows this. The timing circuit 151 supplies the touch sensor 150 with a signal 161 indicating the first phase, causing it to perform the chattering prevent processing and the touch response detect processing. Upon completion of the processing of a predetermined number of keyboards, the second phase is immediately initiated, in which the timing circuit 151 provides to the CPU 152 an interrupt signal which is a data bus occupation request signal as well. Supplied with this signal, the CPU 152 places a data bus terminal in a three-state condition to prevent a bus fight and then enters the wait state, as shown in FIG. 23C. At the same time, the timing circuit 151 provides a control signal 163 to the DMA counter 156 to put it in operation. Then the DMA counter 156 supplies address signals for the DMA transfer one after another to the system RAM 53 and the buffer memory 155 in the touch sensor 150. Upon completion of the processing of a predetermined number of keyboards in this second phase, the timing circuit 151 applies a control signal 163 to the DMA counter 156 to make it inoperative and, further, provides to the CPU 152 an interrupt end signal 162 which is a data bus occupation enable signal as well. Then the CPU 152 returns the data bus terminal to its normal state, resuming the process stacked at the point of interruption, as depicted in FIG. 23C. Such an operation features that the touch sensor block and the CPU system block independently operate entirely asynchronously so that loss of time by their wait state during the data transfer is minimized through utilization of the DMA transfer which is a high efficiency process. In the system of the present invention, this method can be implemented only by newly providing the DMA counter 156, and hence is an effective data transfer method in terms of curcuit arrangement, too. Incidentally, the CPU 152 usually processes plural kinds of processing routines on the time-shared basis using another interrupt signal also in real-time control of the tone generator, and in this case, it is necessary only to decide the priority of execution through use of a well-known priority decision circuit. Apparently the data transfer request by the system of the present invention is high in priority, but in some cases processing of higher priority (for example, instantaneous power cutoff processing or the like) occurs, so that the decision processing varies with individual conditions. Further, it is well-known technically and is not directly related to the present invention, so no futher description will be given thereof.

Figure 24:
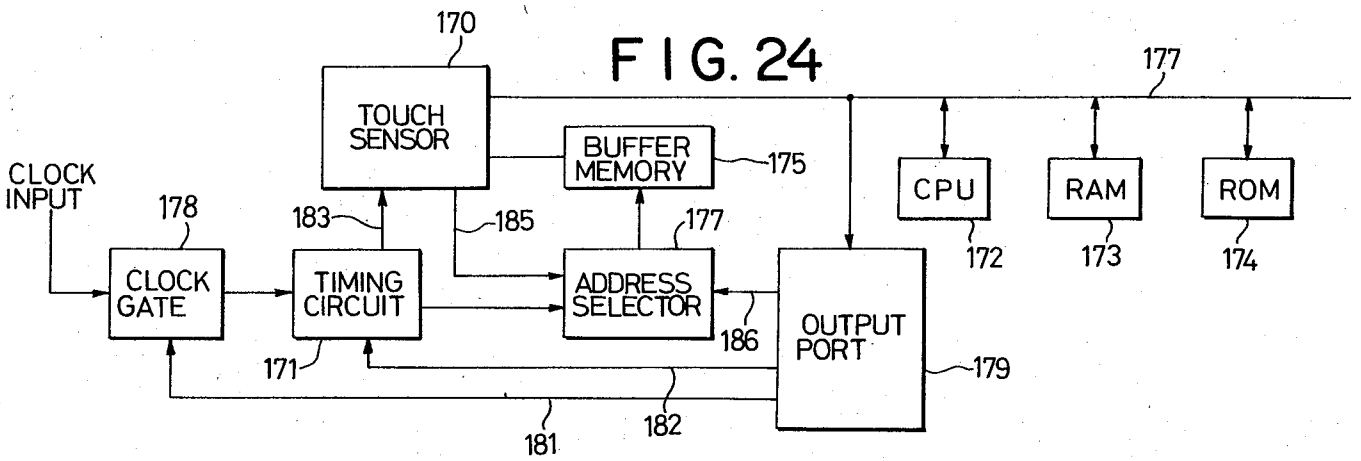
FIG. 24 is a block diagram illustrating, as a second example for implementing the data transfer, another specific arrangement of the transfer circuit 24 and its associated circuits in FIG. 21.
Figure 26:
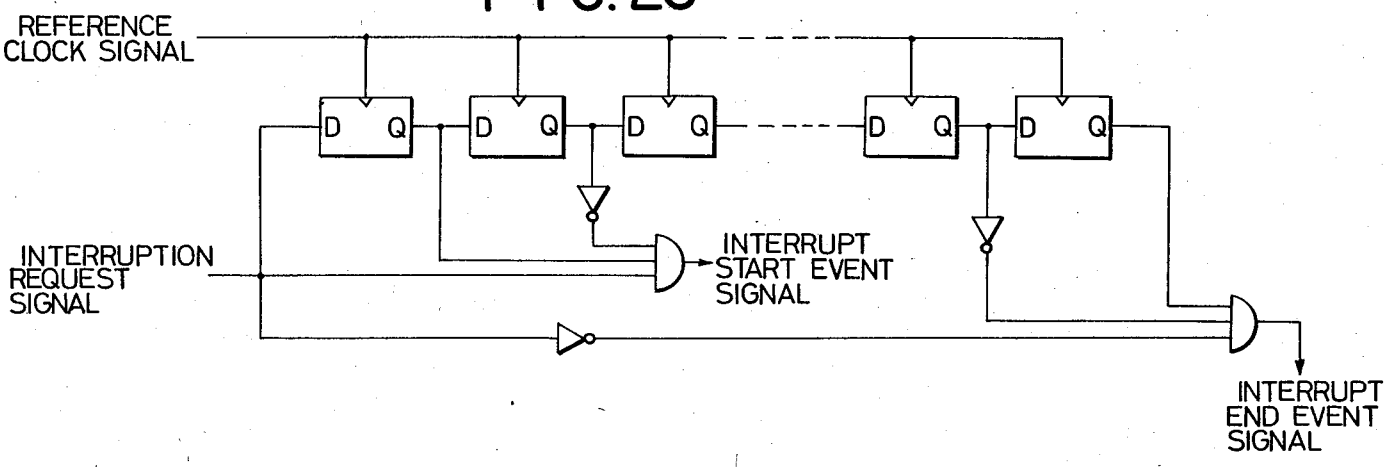
FIG. 26 is a block diagram illustrating an example of a simple delay circuit which is added to a timing circuit 171 in FIG. 24.
Figure 25:
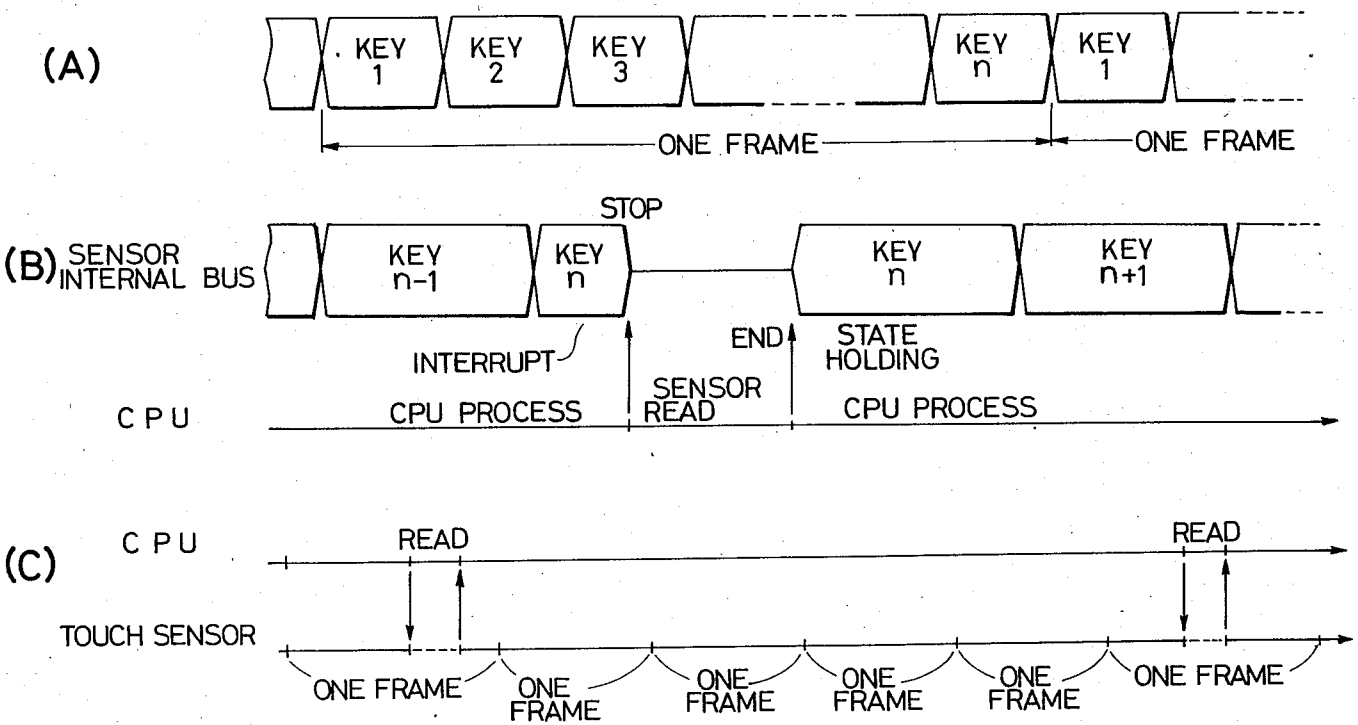
FIGS. 25A to 25C are diagrams for explaining the operation of the arrangement shown in FIG. 24.

FIG. 24 illustrates a second example of the above data transfer system. In FIG. 24 reference numeral 170 indicates a touch sensor which creates touch response data, 171 a timing circuit in the touch sensor 170, 172 a CPU controlling the entire tone generator, 173 a system RAM for temporarily storing the touch response data and data concerning system operations, 174 a ROM for storing fixed data, programs and so on, 175 a buffer memory in the touch sensor 170, 176 an address selector, 177 a system bus including an address bus, a data bus, a control bus, etc., 178 a clock gate and 179 an output port. The operation of this example will be described with reference to FIG. 25. The touch sensor does not have the operation phase in which to voluntarily control the data transfer as in the above example, but it forms one frame only by the operation of performing the touch response detect processing (including the chattering prevent processing) for each key, as shown in FIG. 25A. Assuming that the processing for each key takes place in order KEY1, KEY2, . . . and KEYn and that the processing of 61 keys is effected using, for instance, 1 μsec for the chattering prevention and 1 μsec for the touch response detection for each key, the time for one frame is 122 μsec when no interruption is caused. In the above example the CPU enters the wait state upon each occurrence of an interruption from the touch sensor, whereas in this example the CPU 172 takes the intiative of the entire system of the musical instrument including the touch sensor, and as shown in FIG. 25B, the operation of the CPU 172 proceeds without any wait state thereof. That is, the CPU processes a lot of work such as generator assignment from the keyboard state, the specification of a pitch, the triggering of an envelope, the setting of various status parameters, etc., but the processing is preferentially carried out without encountering any stop request. For instance, when information of a specific keyboard is required in the generator assignement processing, the CPU 172 applies an interrupt request signal to the touch sensor 170 and receives the desired data. This operation will be described as an operation of the circuit arrangement shown in FIG. 24. For example, when recognizing the ON-event status of each keyboard switch, the CPU 172 provides a required control signal and processing channel information corresponding to the keyboard to the output port 179. A part of the signal of the output port 179 acts as a gate signal 181 which controls the clock gate 178 which supplies a system clock signal to the timing circuit 171, and at this point the time sharing operation in the touch sensor stops. Furthermore, a part of the signal of the output port 179 is supplied as a control signal 182 for switching the operation of the timing circuit 171. The timing circuit responds to the control signal 182 to switch the operation of the touch sensor 170 from the chattering prevent/touch response detect operation mode to the data transfer mode. Moreover, as required, the timing circuit 171 supplies the tough sensor 170 with a control signal 183 for switching an internal bus and controlliong a three-state gate, and provides an address select signal 184 to the address selector 177. To the address selector 177 is applied from the touch sensor 170 an address signal 185 which accompanies an ordinary chattering prevent/touch response detect operation. In the transfer mode the address selector 177 is supplied with a processing channel information signal 186 corresponding to the keyboard being processed, which is required by the CPU 172, and the signal 186 is selected by the address select signal 184 from the timing circuit 171 and is provided to the buffer memory 175. By such a series of operations, the CPU 172 interrupts the touch sensor 170 to read out necessary information, and after having accepted the data, the CPU 172 yields an interrupt release signal and then continues necessary processing operations, as depicted in FIG. 25B. On the other hand, the touch sensor circuit does not immediately respond to the interrupt release signal from the CPU 172 to resume its operation, but as shown in FIG. 25B, it remains in the state at the point of occurrence of the interrupt for a predetermined period of time after reception of the interrupt release signal, Ihereafter resuming its normal operation. The reason for this is as follows: Since the interrupt from the CPU 172 is entirely asynchronous with the internal operation timing of the touch sensor 170, it is likely that when data of a memory or data in the process of operation is still undefined, an interrupt occurs to stop the time sharing operation in the touch sensor, and if this state is immediately followed by the nest state, then the abovesaid data may sometimes become meaningless. This can be avoided by providing a certain status repeating and holding period. To perform this, it is necessary only to add to the timing circuit 171 such a simple delay circuit as shown in FIG. 26. With such a data transfer system as described above, the CPU 172 is free from the wait state which causes loss of time, and is able to always operate with the highest efficiency, as shown in FIG. 25C, whereas, as the operation of the touch sensor 170, the length of one frame varies in accordance with n interruption from the CPU 170, Since the variation in the time of one frame acts as an error in each of the chattering prevent operation parameter and the touch response detect operation parameter, as will be evident from the previous description given of the chattering preventing operation and the touch response detecting operation, the evaluation of this factor is of importance. For instance, in the case of processing 61 eys as described previously, when no interrupt occurs, the time of one frame is 122 μsec, and if an interrupt request is made from the CPU 172, an extra data transfer time of 200 to 300 nsec is taken for each key. Further, where the aforementioned status repeating and holding period is up to 1 μsec, an interrupt per frame will cause a 1% error. Incidentally, since processing such as generator assignment and musical tone generation is also effected by the CPU 172, the frequency of requesting the touch sensor 170 for the keyboard information in practice is presumable, ahd the condition "one frame scan =several to 10 msec" which is required as the keyboard scanning speed in view of the humen's discrimination is of help. Namely, even if the scanning speed of "several msec" which is rather severe as the condition for processing is adopted, an interrupt occurs every 50 frames of the operation of the touch sensor in practice, resulting im about 0.02% error. In terms of the bit precision, this is a capability above 12 bits, and is sufficient as the touch response characteristic of an electronic musical instrument. As described above, when this data transfer system is employed, the CPU does not stop all the states including an instruction fetch unlike in the foregoing example but only the data read cycle is used as the interrupt period, so that the performance of the system is further improved. Furthermore, according to this system, it is possible to embody a novel concept of accessing the overall touch sensor block regarding it as "one memory having written therein touch response data". This provides many possibilities in electronic musical instruments as a very useful element such as a "touch response LSI" which is a kind of variation of a conventional "generalpurpose peripheral LSI family" centering on a CPU.

As described above, the electronic musical instrument of the present invention implements, with a simple circuit arrangement, high-speed touch response detect operation processimg and chattering prevent operation processing which are difficult to be performed by a CPU, and effects a proper data transfer to a musical tone generator which performs a musical tone generating operation asynchronously and in the optimum state, thereby achieving touch response processing which is free from limitations on the number of tone to be simultaneously produced and the generator assignment system in terms of hardware. Moreover, high precision, high resolution two-bit data is set as data for internal processing and touch response data having such a nautral temporal variation curve as is obtainable with a time constant circuit system is operated directly by an operation control circuit and anadder thereby offering a high efficiency and compact touch response system which is suitable for fabrication as an LSI, and hence providing at low cost an electronic musical instrument which is excellent in its touch response chracteristic and rich in musicality. Accordingly, the present invention greatly contributes to the realization of good quality music.

It will be apparent that many modifications and variations may be effected without departing from the scope of the novel concepts of the present invention.

What is claimed is:

1. An electronic musical instrument which has a keyboard and produces a musical tone by striking a key of the keyboard, comprising:

an operation control circuit and an adder both for performing chattering prevent operation processing and touch response detect operation processing of keyboard switches;

a timing control circuit for controlling the switching between the chattering preventing operation and the touch response detecting operation and the scanning of the keyboard switches to detect their status;

a musical tone generator which performs a musical tone producing operation asynchronously with the keyboard switch scanning operation and the chattering preventing and touch response detecting operations of the keyboard switches; and a transfer circuit for transferring touch response information to the musical tone generator; wherein the musical tone produced by striking the key of the keyboard has a touch response characteristic corresponding to the key striking force;

a first switch which is procided for each key and changes its state in response to the striking of the key;

a second switch which is provided for each key and changes its state with a time lag relative to the first switch;

a timing circuit for generating a phase signal serving as a reference of a chattering eliminating operation and the touch response detecting operation, a scanning signal, an address signal and a control signal;

a scan and detect circuit for scanning either one of the first and second switches by the scanning signal from the timing circuit to detect their status;

a first memory which responds to the control signal from the timing circuit to temporarily store a switch detected signal from the scan and detect circuit;

a control circuit which responds to the phase signal and the control signal from the timing circuit to perform a predetermined control operation;

a second memory which responds to the control signal from the timing circuit to temporarily store the output signal of the first memory and a switch status signal having chattering eliminated by the control circuit;

a third memory which responds to the control signal from the timing circuit to temporarily store the output signal of the second memory and to supply it as first switch information to the control circuit;

a data bus which time-shares various data signals and various control signals of the entire system; a fifth memory which responds to the control signal from the timing circuit to temporarily store the signal on the data bus and to supply it to the control circuit;

a sixth memory which responds to the control signal and the address signal from the timing circuit to temporarily store the signal on the data bus;

an adder which performs an add-operation of the output signal of the control circuit to obtain touch response information or chattering prevent information;

a gate circuit which responds to the control signal from the timing signal to provide the output signal of the adder and the output signal of the control circuit on the data bus;

a musical tone generator which is supplied with a musical parameter by the signal on the data bus to generate the musical tone; and a control circuit which controls the musical tone generator and the timing circuit to reflect a touch response characteristic in a musical tone signal.

2. An electronic musical instrument according to claim 1 wherein the timing circuit includes a first interrupt control circuit which inhibits the phase signal, the scanning signal, the address signal and the control signal from undergoing status changes while the control circuit accesses required information on the data bus, and holds the status of the phase signal, the scanning signal, the address signal and the control signal unchanged for a predetermined period of time after completion of the occupation of the data bus by the control circuit, whereby the touch response information is created asynchronously corresponding to an arbitrary interrupt request by the control circuit.

3. An electronic musical instrument according to claim 1 wherein the timing circuit includes a second interrupt control circuit for occupying the data bus by interrupting the control circuit with a predetermined period in an operation phase in which the chattering prevent operation or touch response detect operation is performed by the control circuit and the adder, and an address generator which is enabled by an enable signal from the second interrupt control circuit to create an address signal for effecting a direct memory access transfer of required information to the control circuit via the data bus, whereby an interrupt is periodically requested to the control circuit, transferring thereto to touch response information.

4. An electronic musical instrument according to claim 2 or 3 which further comprises a bit operation circuit for switching input/output bits of the fifth memory and the gate circuit in response to the phase signal from the timing circuit, and wherein the timing circuit generates eight phase signals representing eight basic phases and processes, with the same circuit arrangement on a time-shared basis, the first phase in which the first switches are scanned by the scan and detect circuit to detect their status and the previous switch status and the previous chattering eliminating operation parameter are set by the fifth memory, the second phase in which a new switch status signal and a new chattering eliminating operation parameter obtained by the control circuit and the adder are supplied to the second memory and the gate circuit, the third phase in which the second switches are scanned by the scan and detect circuit to detect their status and the previous switch status and the previous chattering eliminating operation parameter are set by the fifth memory, the fourth phase in which a new switch status signal and a new chattering eliminating operation parameter obtained by the control circuit and the adder are supplied to the second memory and the gate circuit, the fifth phase-in which a chattering-eliminated first switch status signal and some. bits of the previous touch response operation parameter are set by the third and fifth memories, the sixth phase in which a chattering-eliminated second switch status signal and the remaining bits of the previous touch response operation parameter are set by the fourth and fifth memories, the seventh phase in which a new switch status signal and some bits of a new touch response operation parameter obtained by the control circuit and the adder are supplied to the gate circuit, and the eighth phase in which a new switch status signal and the remaimimg bits of a new touch response operation parameter obtained by the control circuit and the adder are supplied to the gate circuit, thereby effecting a high precision touch response detection using a touch response information having a larger number of bits than does the touch response information which is supplied via the control circuit to the musical tone generator.

5. An electronic musical instrument according to claim 4 wherein in a phase in which to perform the chattering eliminating operation by the control circuit and the adder, when an ON even of the switch information im the first memory occurs, a switch ON signal is output and a predetermined initial value is set as the chattering eliminating operation parameter, after which each time the operation processing is specified by the timing circuit, a predetermined incremental value is added and when a predetermined set value is reached, that status is held unchanged; and when an OFF event of the switch information in the first memory occurs, a predetermined intial value is set as the chattering eliminating operation parameter, after which each time the operation processing is agaim specified by the timing circuit, a predetermined incremental value is added and when a predetermined set value is reached, that status is held unchanged and a switch OFF status signal is output, whereby an OFF event within a fixed period of time is masked against the swich information in the first memory.

6. An electronic musical instrument according to claim 5 wherein in a phase in which to perform the touch response detecting operation by the control circuit and the adder, when an ON event of the switch information in the third memory occurs, a predetermined initial value is set as the touch response operation parameter, after which each time the operation processing is again specified by the timing circuit, data in which a specified number of high-order bits of the touch response operation parameter are inverted to be shifted to a specified number of low-order bits and the remaining bits are inverted is added; and when an ON event of the switch informat.ion in the fourth memory occurs, the state of the touch response operation parameter is held unchanged and thereafter a change in the status is inhibited until occurrence of an OFF event of the switch information in the third memory, thereby obtaining touch response information which varies substantially exponentially corresponding to a time required from the occurrence of the ON event of the switch information in the third memory to the occurrence of the ON event of the switch information in the fourth memory.

7. An electronic musical instrument according to claim 6 wherein the control circuit and the musical tone generator are partly formed by a microcomputer, the data bus is shared with the system bus of the microcomputer and the sixth memory is shared as a part of a RAM of the microcomputer system.

* * * * *